US011491801B2

(12) United States Patent
Hoshi

(10) Patent No.: US 11,491,801 B2
(45) **Date of Patent: *Nov. 8, 2022**

(54) THERMAL HEAD FOR PRINTER

(71) Applicant: SATO HOLDINGS KABUSHIKI KAISHA, Tokyo (JP)

(72) Inventor: Kazuyuki Hoshi, Saitama (JP)

(73) Assignee: SATO HOLDINGS KABUSHIKI KAISHA, Tokyo (JP)

( * ) Notice: Subject to any disclaimer, the term of this patent is extended or adjusted under 35 U.S.C. 154(b) by 53 days.

This patent is subject to a terminal disclaimer.

(21) Appl. No.: 17/092,620

(22) Filed: Nov. 9, 2020

(65) Prior Publication Data

US 2021/0053366 A1 Feb. 25, 2021

Related U.S. Application Data

(62) Division of application No. 15/907,890, filed on Feb. 28, 2018, now Pat. No. 10,882,328.

(51) Int. Cl.

| | |
|---|---|
| ***B41J 2/33*** | (2006.01) |
| ***B41J 2/335*** | (2006.01) |
| ***B41J 2/32*** | (2006.01) |

(52) U.S. Cl.

CPC ..... *B41J 2/3352* (2013.01); *B41J 2/32* (2013.01); *B41J 2/33515* (2013.01); *B41J 2/33575* (2013.01)

(58) Field of Classification Search

CPC . B41J 2/3352; B41J 2/32; B41J 25/304; B41J 2/33515; B41J 2/33575

See application file for complete search history.

(56) References Cited

U.S. PATENT DOCUMENTS

| | | | |
|---|---|---|---|
| 5,366,302 | A | 11/1994 | Masumura et al. |
| 5,565,905 | A | 10/1996 | Kajiya et al. |
| D375,975 | S | 11/1996 | Koizumi et al. |
| 5,694,159 | A | 12/1997 | Kajiya et al. |
| 5,779,371 | A | 7/1998 | Aoyama et al. |
| D410,949 | S | 6/1999 | Fowkes |
| 6,307,580 | B1 | 10/2001 | Yoshikawa |
| D542,344 | S | 5/2007 | Duby et al. |
| 7,399,130 | B2 | 7/2008 | Hirte et al. |
| 8,068,127 | B2 | 11/2011 | Ochiai et al. |

(Continued)

FOREIGN PATENT DOCUMENTS

| | | |
|---|---|---|
| EP | 0 765 761 A1 | 4/1997 |
| EP | 1 914 083 A1 | 4/2008 |

(Continued)

OTHER PUBLICATIONS

Japanese Office Action and English Translation, Application No. 2018-539603, dated Oct. 27, 2020, 10 pages.

(Continued)

*Primary Examiner* — Kristal Feggins
(74) *Attorney, Agent, or Firm* — Foley & Lardner LLP

(57) ABSTRACT

A printer includes a thermal head, an electrical connector capable of being connected to and disconnected from the thermal head, and a head cover of the thermal head. The head cover moves between a first position and a second position different from the first position to connect and disconnect the thermal head and the electrical connector.

14 Claims, 22 Drawing Sheets

(56) References Cited

U.S. PATENT DOCUMENTS

| | | | |
|---|---|---|---|
| D652,446 | S | 1/2012 | Brady et al. |
| D653,284 | S | 1/2012 | Amidon et al. |
| D689,439 | S | 9/2013 | Yu et al. |
| 8,564,633 | B2 | 10/2013 | Matsushima et al. |
| 8,610,752 | B2 | 12/2013 | Tsugaru |
| 9,662,900 | B1 | 5/2017 | Liu et al. |
| D849,690 | S | 5/2019 | Luo |
| D859,317 | S | 9/2019 | Huang et al. |
| D873,341 | S | 1/2020 | Horikawa et al. |
| D901,390 | S | 11/2020 | Ma et al. |
| 10,882,328 | B2 * | 1/2021 | Hoshi ..... B41J 2/33515 |
| 2001/0005216 | A1 | 6/2001 | Takahashi et al. |
| 2002/0033874 | A1 | 3/2002 | Aubin et al. |
| 2002/0048479 | A1 | 4/2002 | Bryant et al. |
| 2003/0146968 | A1 | 8/2003 | Milton |
| 2008/0094463 | A1 | 4/2008 | Tsuchida et al. |
| 2011/0193926 | A1 | 8/2011 | Matsushima et al. |
| 2011/0193927 | A1 | 8/2011 | Matsushima et al. |
| 2012/0212562 | A1 | 8/2012 | Tsugaru |
| 2016/0347093 | A1 | 12/2016 | Ogasawara et al. |
| 2019/0299679 | A1 | 10/2019 | Ushiama |

FOREIGN PATENT DOCUMENTS

| | | | |
|---|---|---|---|
| EP | 2 641 745 | A1 | 9/2013 |
| JP | 57-088131 | U | 5/1982 |
| JP | 07-081179 | A | 3/1995 |
| JP | 07-256977 | A | 10/1995 |
| JP | 2989024 | B2 | 12/1999 |
| JP | 2003-220722 | A | 8/2003 |
| JP | 2005-324374 | A | 11/2005 |
| JP | 2006-334952 | A | 12/2006 |
| JP | 2006-334953 | A | 12/2006 |
| JP | 2007-136931 | A | 6/2007 |
| JP | 2012-171114 | A | 9/2012 |
| JP | 2014-133364 | A | 7/2014 |
| WO | WO-2018/051767 | A1 | 3/2018 |
| WO | WO-2018/051769 | A1 | 3/2018 |
| WO | WO-2018/051770 | A1 | 3/2018 |
| WO | WO-2018/051771 | A1 | 3/2018 |

OTHER PUBLICATIONS

Japanese Office Action and English Translation, Application No. 2018-539605, dated Nov. 4, 2020, 6 pages.
Japanese Office Action and English Translation, Application No. 2018-539606, dated Oct. 20, 2020, 6 pages.
Japanese Office Action and English Translation, Application No. 2018-539607, dated Nov. 4, 2020, 4 pages.
Notice of Allowance, U.S. Appl. No. 16/607,427, dated Nov. 25, 2020, 11 pages.
Extended European Search Report, Application No. 20213458.1, dated Apr. 26, 2021, 18 pages.
U.S. Appl. No. 15/759,061, filed Mar. 9, 2018, Kazuyuki Hoshi et al.
U.S. Appl. No. 15/759,331, filed Mar. 12, 2018, Kazuyuki Hoshi et al.
U.S. Appl. No. 15/759,337, filed Mar. 12, 2018, Kazuyuki Hoshi et al.
U.S. Appl. No. 15/759,383, filed Mar. 12, 2018, Kazuyuki Hoshi et al.
U.S. Appl. No. 16/607,427, filed Oct. 23, 2019, Sato Holdings Kabushiki Kaisha.
U.S. Appl. No. 29/638,654, filed Feb. 28, 2018, Kazuyuki Hoshi et al.
U.S. Appl. No. 29/659,475, filed Aug. 9, 2018, Yasuhide et al.
Chinese Office Action and English translation, Application No. 201780055650.8, dated Mar. 3, 2020, 13 pages.
Chinese Office Action, Application No. 201780045890.X, dated Jan. 2, 2020, 7 pages.
Chinese Office Action, Application No. 201780045900.X, dated Jan. 2, 2020, 7 pages.
Chinese Office Action, Application No. 201780045904.8, dated Dec. 26, 2019, 6 pages.
European Office Action, Application No. 17 850 671.3, dated Mar. 18, 2020, 6 pages.
European Office Action, Application No. 17 850 674.7, dated Mar. 18, 2020, 5 pages.
European Search Report, Application No. 17850671.3, dated Jul. 30, 2019, 11 pages.
European Search Report, Application No. 17850673.9, dated Jul. 9, 2019, 8 pages.
European Search Report, Application No. 17850674.7, dated Jul. 30, 2019, 8 pages.
European Search Report, Application No. 17850675.4, dated Jul. 16, 2019, 9 pages.
Google translation of JP 2006-334953, published on Dec. 2006. (Year: 2006).
Google translation of JP 2007-136931, published on Jun. 2007, 5 pages.
How to install a PCI or PCI-Express expansion card, by lowendguru, dated Aug. 5, 2014, youtube.com [online]. Retrieved Aug. 2, 2020 from internet <URL:https://www.youtube.com/watch?time_continue=22&v=p9pTv1S5gsw&feature=emb_logo> (Year: 2014).
HP300312A-G02 16 pins SHEC C56 Thermal Head for Talco Printer, dated Dec. 16, 2017, printhead-barcode.com [online]. Retrieved Aug. 2, 2020 from the internet <URL:http://www.printhead-barcode.com/index.php?main_page=product_info&products_id=2965>(Year: 2017).
Human English Translation of JP 2006-334952, 39 pages.
IBM aCard IDE to LVD-SCSI Bridge Adapter, posted 2010, retrieved Jun. 20, 2020 from https://www.amazon.com/aCard_LVD_SCSi_Bridge-Adapter-AEC-7722/dp/B00BNHQ3BE/ref=V4ASHR022K3H&dchild=1&keyword=.
Machine-generated translation of JP 2006-334952, published on Dec. 2006, 17 pages.
Notice of Allowance, U.S. Appl. No. 15/759,061, dated Jan. 15, 2020, 12 pages.
Notice of Allowance, U.S. Appl. No. 15/759,383, dated May 5, 2020, 9 pages.
USPTO Notice of Allowance, U.S. Appl. No. 15/759,061, dated Jan. 24, 2019, 15 pages.
USPTO Notice of Allowance, U.S. Appl. No. 15/759,061, dated Nov. 13, 2019, 13 pages.
USPTO Notice of Allowance, U.S. Appl. No. 15/759,331 dated Jan. 31, 2019, 13 pages.
USPTO Notice of Allowance, U.S. Appl. No. 15/759,331, dated May 8, 2019, 21 pages.
USPTO Notice of Allowance, U.S. Appl. No. 15/759,337, dated Jul. 15, 2019, 9 pages.
USPTO Notice of Allowance, U.S. Appl. No. 15/759,383 dated Dec. 3, 2019, 9 pages.
USPTO Notice of Allowance, U.S. Appl. No. 29/659,475, dated Oct. 20, 2020, 7 pages.
USPTO Office Action, U.S. Appl. No. 15/759,061, dated May 7, 2019, 14 pages.
USPTO Office Action, U.S. Appl. No. 15/759,337, dated Apr. 10, 2019, 11 pages.
USPTO Office Action, U.S. Appl. No. 15/759,383, dated Jan. 13, 2020, 6 pages.
USPTO Office Action, U.S. Appl. No. 15/759,383, dated Jul. 23, 2019, 12 pages.
USPTO Office Action, U.S. Appl. No. 15/759,383, dated Apr. 12, 2019, 12 pages.
USPTO Office Action, U.S. Appl. No. 16/607,427, dated Aug. 7, 2020, 18 pages.
USPTO Office Action, U.S. Appl. No. 29/638,654, dated Aug. 6, 2020, (U.S. 2018/0186155, U.S. 20020163204, D621060, D280109, D846955, D434909, D433237, D875056, D843334, D798822, D757666, D753073, D733056, D465772).
USPTO Office Action, U.S. Appl. No. 29/659,475, dated Jun. 25, 2020, 10 pages.

(56) References Cited

OTHER PUBLICATIONS

USPTO Restriction Office Action, U.S. Appl. No. 29/659,475, dated Feb. 20, 2020, 14 pages.
Kyocera Avery Monarch KPA-104-8TAW1-MM1 Thermal Label Printer Print Head, posted NA [online], (retrieved Feb. 4, 2021). Retrieved from the internet, https://www.ebay.com/c/1451731436?iid=313285433051 (Year: NA), 4 pages.
USPTO Notice of Allowance, U.S. Appl. No. 29/731,950, dated Feb. 18, 2021, 33 pages.
USPTO Office Action, U.S. Appl. No. 29/638,654, dated Feb. 9, 2021, 11 pages.
Extended European Search Report Issued in European Patent Application No. 18907605.2 dated Feb. 25, 2021, 7 pages.
USPTO Notice of Allowance, U.S. Appl. No. 29/638,654, dated Sep. 3, 2021, 11 pages.

* cited by examiner

THERMAL HEAD FOR PRINTER

CROSS-REFERENCE TO RELATED APPLICATIONS

This application is a divisional application of U.S. application Ser. No. 15/907,890, filed Feb. 28, 2018, the entire contents of which is incorporated herein by reference.

BACKGROUND OF THE INVENTION

The present invention relates to thermal heads for printers.

A thermal printer prints information on labels typically, and includes a thermal head. Since the thermal head is a consumable, it needs replacing.

When the thermal head is replaced, electrical connections between the thermal head and the controlling electronics in the printer are disconnected and reconnected by hand.

SUMMARY OF THE INVENTION

The inventors have realized that problems occur in making the electrical connections between the thermal head and the controlling electronics in the printer. The electrical connectors from the controlling electronics are at the ends of wires from the printer. The electrical connections between the thermal head and the controlling electronics must be disconnected and reconnected by hand. The space for inserting hands and fingers to accomplish the disconnection and reconnection is limited and thus the disconnection and reconnection procedure is difficult and time consuming. Also, the user may not know the correct amount of force to use in making the disconnection and reconnection, and thus it is easy for the user to apply excessive force and damage the electrical connections.

Also, users of a thermal printer are often unfamiliar with the replacement of a thermal head. For such users, the replacement of a thermal head is a burden.

The present subject matter aims to facilitate and improve the replacement of a thermal head.

According to one embodiment, a thermal head for a printer comprises a heater element configured to print information; and a male electrical connector configured to mate with a female electrical connector which moves in response to movement of a thermal head cover.

According to another embodiment, a thermal head for a printer comprises a heater element configured to print information; and a female electrical connector configured to mate with a male electrical connector which moves in response to movement of a thermal head cover.

DETAILED DESCRIPTION OF EMBODIMENTS OF THE INVENTION

Figure 1:
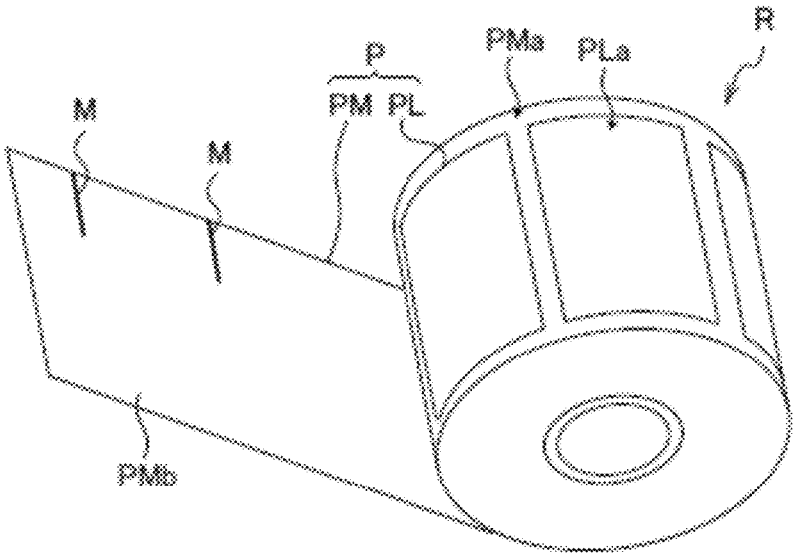
FIG. 1 schematically describes a print medium of the present embodiment.

The following describes embodiments of the invention.

The following describes embodiments of the present invention in detail, with reference to the drawings. In the drawings describing the embodiments, like numbers indicate like components, and their repeated description is omitted.

In the following description, "FR" refers to the front of a printer and "RR" refers to the rear of the printer.

"UP" refers to the upward when the printer is placed on a horizontal plane, and "LO" refers to the downward when the printer is placed on a horizontal plane.

"LH" and "RH" refer to the direction (hereinafter called a "width direction") orthogonal to the front-rear direction and the up-down direction of the printer.

A part of the printer closer to the container than any referential position on the feed path is referred to the part located "upstream in the feeding direction". A part of the printer closer to the ejection port than the referential position is referred to the part located "downstream in the feeding direction".

(1) Print Medium

The following describes a print medium of the present embodiment. FIG. 1 schematically describes a print medium of the present embodiment.

As shown in FIG. 1, a print medium P of the present embodiment includes a liner PM and a plurality of labels PL.

The liner PM includes a temporary-adhesive face PMa and a non-temporary-adhesive face PMb on the other side of the temporary-adhesive face PMa.

The plurality of labels PL temporarily adheres to the temporary-adhesive face PMa at predetermined intervals.

On the non-temporary-adhesive face PMb, reference marks M are formed at predetermined intervals. A reference mark M shows the reference position for a label PL.

Each label PL has a print surface PLa and a sticking surface PLb (not illustrated).

The print surface PLa includes a thermosensitive layer that develops a color by heat.

On the sticking surface PLb, adhesive is applied.

(2) Configuration of Printer

Figure 2:
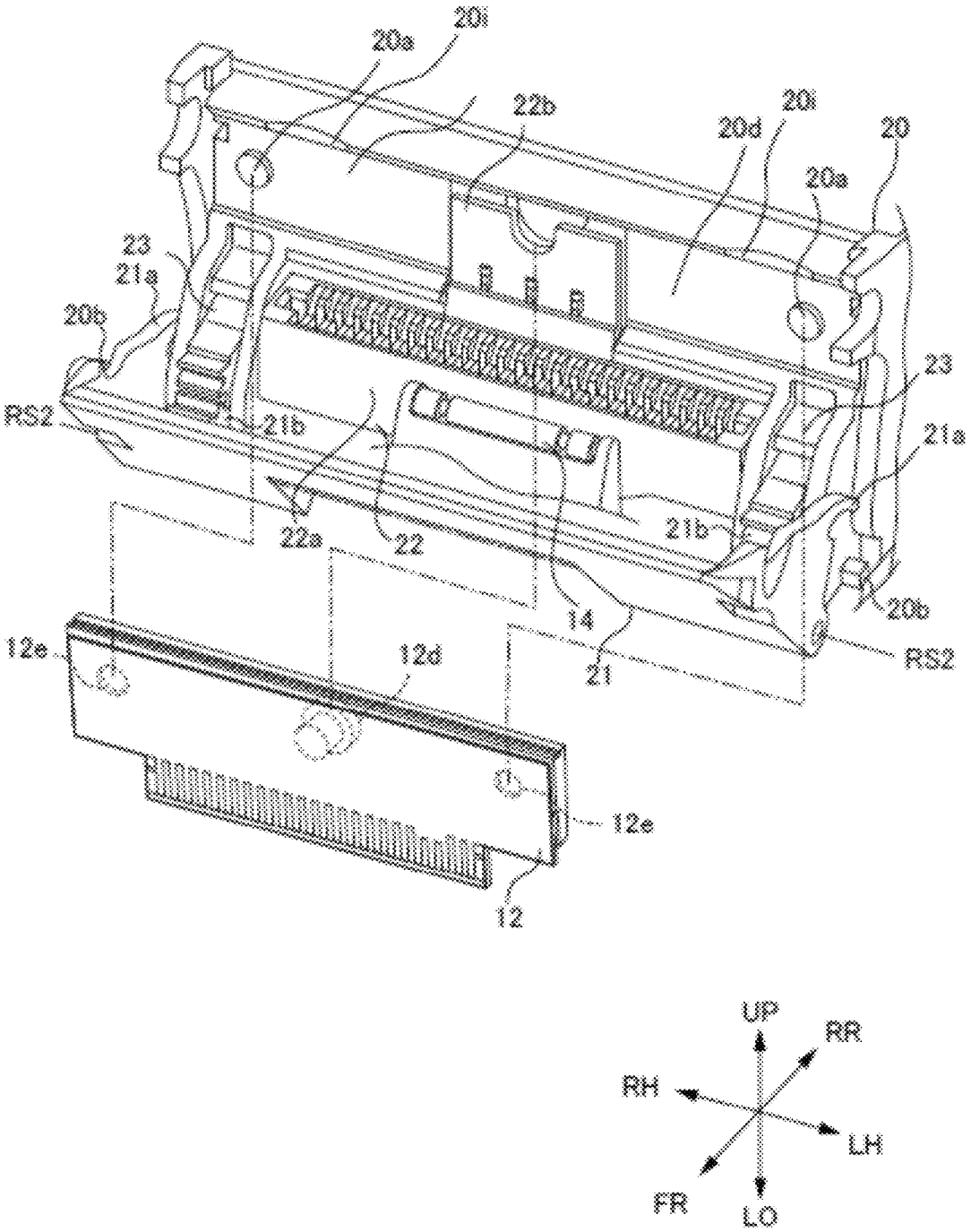
FIG. 2 is a perspective view of a thermal head, head bracket and connector unit.
Figure 5:
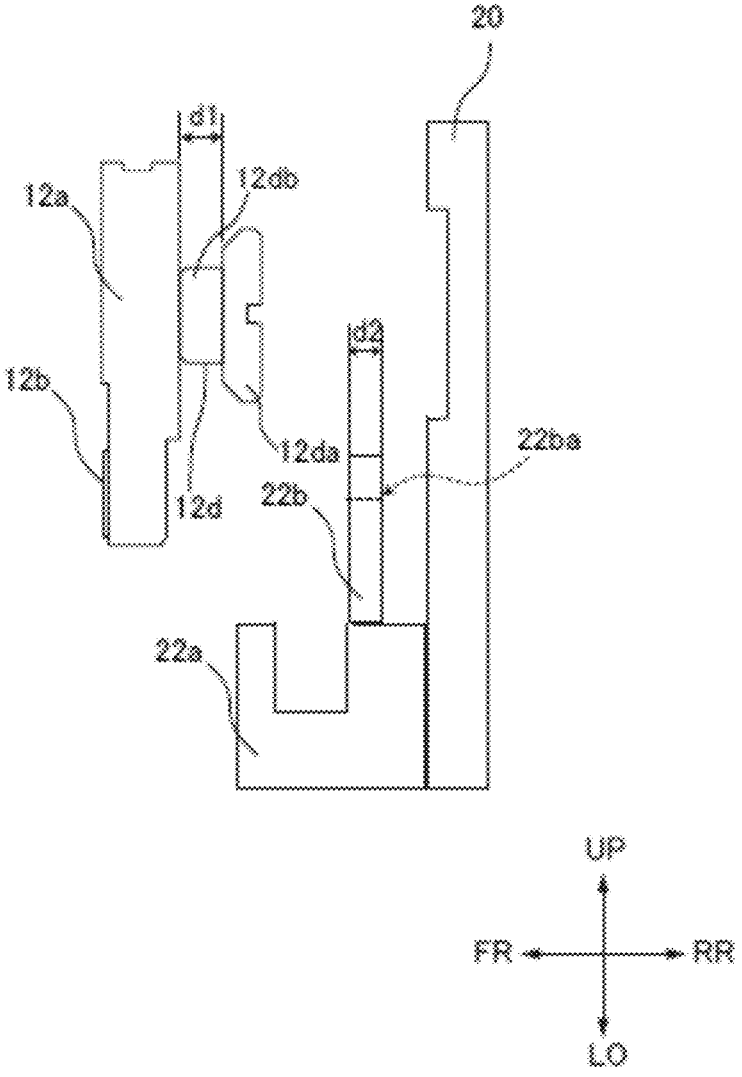
FIG. 5 is a side view of the major parts of the head bracket of FIG. 2, the connector unit of FIG. 3, and the thermal head of FIG. 4.
Figure 6:
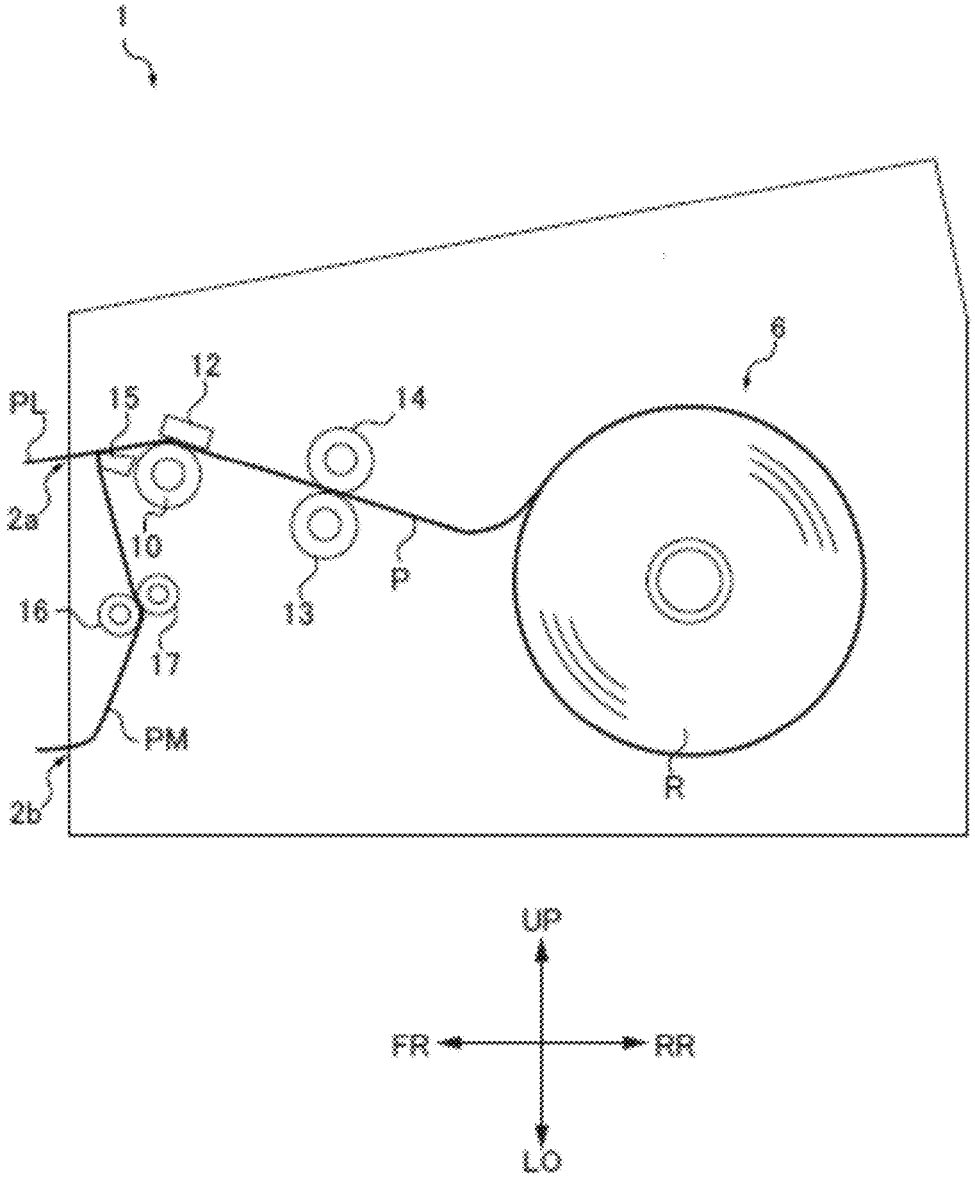
FIG. 6 schematically shows the feed path of the present embodiment.

FIG. 2 is a perspective view of a thermal head 12, a head bracket 20 and a connector unit 22 of a printer 1 (shown in FIG. 6). FIG. 3 shows a major part of connector unit 22 of FIG. 2. FIG. 4 is a perspective view of a major part of thermal head 12 of FIG. 2. FIG. 5 is a side view of the major parts of the head bracket 20 of FIG. 2, the connector unit 22 of FIG. 3, and the thermal head 12 of FIG. 4.

As shown in FIGS. 2 and 6, the printer 1 includes the thermal head 12, a second assisting roller 14, the head bracket 20, a head cover 21, the connector unit 22 (one example of a connecting part) and a pair of gears 23.

The head cover 21 is pivotally supported. The head cover 21 can move (i.e., can rotate) relative to a printer cover 3 (shown in FIGS. 8 and 10) between a shielding position (one example of a first position) and a non-shielding position (one example of a second position) about a rotary axis RS2.

The head cover 21 at the shielding position shields a part of the thermal head 12. In this case, a part of the thermal head 12 and the connector unit 22 are covered by the head cover 21, and therefore they cannot be seen from the outside of the printer 1.

The head cover 21 at the non-shielding position opens the connector unit 22. Specifically a space is defined between the head cover 21 at the non-shielding position and the printer cover 3. The connector unit 22 is exposed through this space. The connector unit 22 has a connector 22*a* (described later) as a connecting terminal, and the connector 22*a* is directed upward (UP). In this case, the thermal head 12 and the connector unit 22 can be seen from the outside of the printer 1.

The second assisting roller 14 is rotatably supported at the printer cover 3.

The second assisting roller 14 assists the feeding of the print medium P while rotating following the rotation of a first assisting roller 13.

As shown in FIG. 2, the head bracket 20 includes a pair of convexes 20*a*, a pair of protrusions 20*b* and a head bracket body 20*d*.

The pair of convexes 20*a* protrudes forward (FR) from the head bracket body 20*d*.

The head cover 21 includes a pair of engaging parts 21*a* and a pair of gears 21*b*.

The pair of engaging parts 21*a* is located at lateral ends of the head cover 21.

The pair of engaging parts 21*a* engages with the pair of protrusions 20*b* so as to lock the head cover 21 at the shielding position.

When a user rotates the head cover 21, the engagement between the pair of engaging parts 21*a* and the pair of protrusions 20*b* is canceled.

Figure 3A:
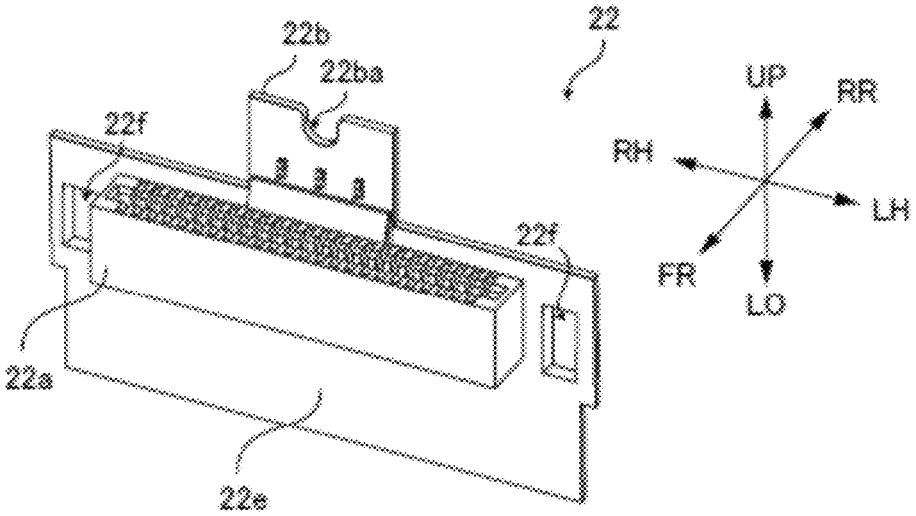
FIGS. 3A and 3B show a major part of a connector unit of FIG. 2.
Figure 3B:
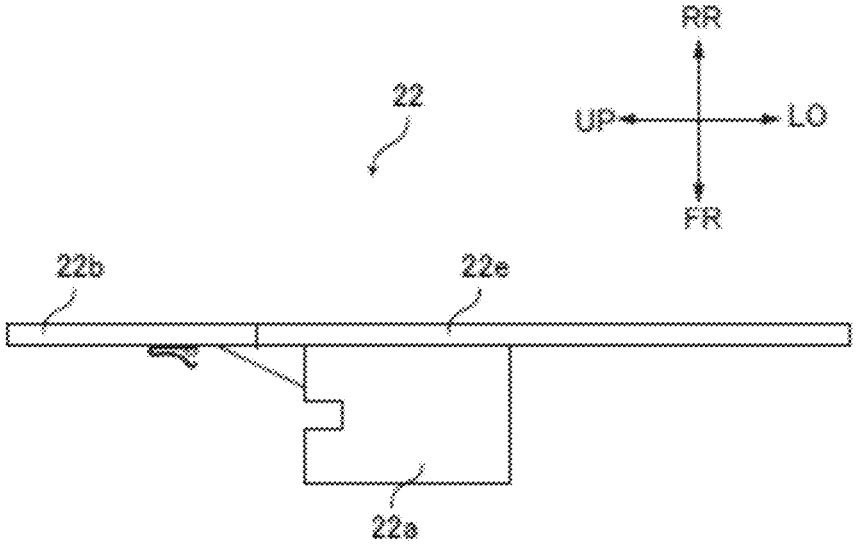

As shown in FIGS. 3A and 3B, the connector unit 22 has a front face. On the front face, the female connector 22*a* (one example of a second connector), an abutting part 22*b*, a connector board 22*e*, and a pair of engagement holes 22*f* are disposed. Abutting part 22*b*, including notch 22*ba* (discussed below), is formed on an extended portion of the connector board 22*e*.

The connector 22*a* is disposed on the front face of the connector board 22*e*.

The abutting part 22*b* protrudes upward (UP) from the upper end of the connector board 22*e*. The abutting part 22*b* has notch 22*ba*. The notch 22*ba* is at a center of the connector unit 22 in the width direction (LH-RH direction).

As shown in FIG. 2, the pair of gears 23 engages with the pair of engagement holes 22*f* and the pair of gears 21*b*. Such engagement converts the rotary motion of the head cover 21 into the motion of the connector unit 22 in the up-down direction (UP-LO direction) via the pair of gears 23.

That is, a gear mechanism is made up of the pair of gears 21*b* and the pair of gears 23, and this gear mechanism is a moving mechanism to join with the connector unit 22 and with the head cover 21. As the head cover 21 is moved, this moving mechanism moves the connector unit 22 (e.g., slides it in the up-down direction (UP-LO direction)) for connection and disconnection of the thermal head 12 and the connector unit 22.

The thermal head 12 can be connected to and disconnected from the connector unit 22.

Figure 4A:
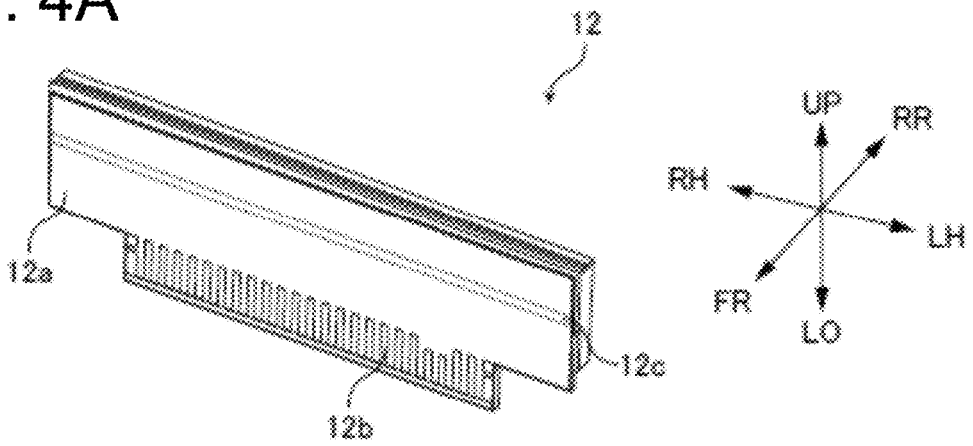
FIGS. 4A and 4B are perspective views of a major part of a thermal head of FIG. 2.

As shown in FIG. 4A, the thermal head 12 has a front face. On the front face, a thermal head body 12*a*, a male connector 12*b* (one example of a first connector), and a plurality of heater elements 12*c* are disposed.

Figure 4B:
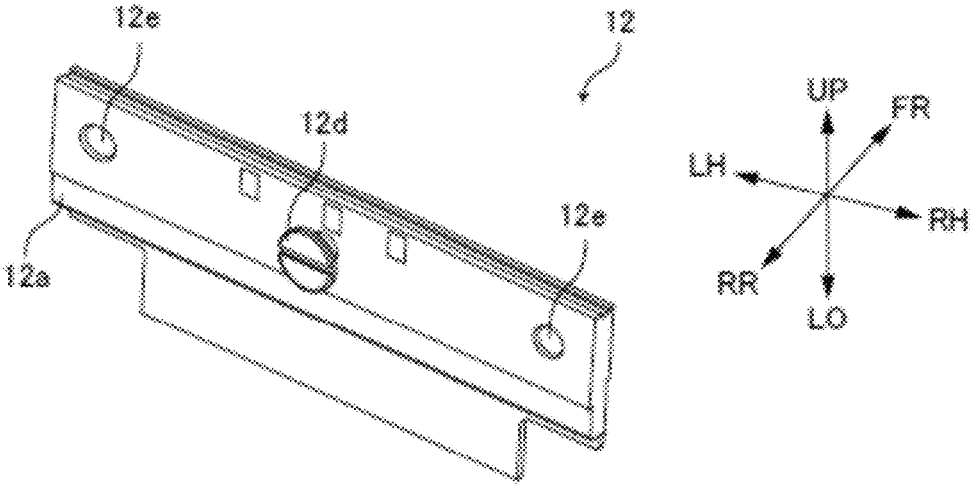

As shown in FIG. 4B, the thermal head 12 has a rear face. On the rear face, a connector unit limiter 12*d* (one example of a connection position limiter, which limits a position of the connector 12*b* relative to the printer, for example, in a direction orthogonal to the moving direction) and a pair of concaves 12*e* are disposed.

The connector 12*b* protrudes downward (LO) from the thermal head body 12*a*. The connector 12*b* is at a center of the thermal head 12 in the width direction (LH-RH direction).

The plurality of heater elements 12*c* is located above (UP) the connector 12*b*. The plurality of heater elements 12*c* is aligned along the width direction (LH-RH direction) of the thermal head 12. This aligning direction of the plurality of heater elements 12*c* is called a "print line direction".

The pair of concaves 12*e* is located on opposite sides (outboard) of the connector unit limiter 12*d* in the width direction (LH-RH direction).

The connector unit limiter 12*d* protrudes rearward (RR) from the rear face of the thermal head body 12*a*.

As shown in FIG. 5, the connector unit limiter 12*d* includes a first limiter 12*da* and a second limiter 12*db*.

The second limiter 12*db* protrudes rearward (RR) from the rear face of the thermal head body 12*a*.

The second limiter 12*db* joins with the thermal head body 12*a* and with the first limiter 12*da*.

The size d1 of the second limiter 12*db* is substantially the same as the size d2 of the notch 22*ba* in the front-rear direction (FR-RR direction).

The connector unit 22 can be connected to and disconnected from the thermal head 12. Connecting of the connector unit 22 to the thermal head 12 establishes a connection of the thermal head 12 to a control circuit (not illustrated).

(3) Feed Path

The following describes a feed path of the present embodiment. FIG. 6 schematically shows the feed path of the present embodiment.

As shown in FIG. 6, the feed path of the print medium P is a path between a container 6 and a separator 15. The feed path of the print medium P extends through the first assisting roller 13, the second assisting roller 14, the thermal head 12 and a platen roller 10.

The feed path of the labels PL is a path between the separator 15 and a label ejection port 2*a*.

The feed path of the liner PM is a path between the separator 15 and a liner ejection port 2*b*. The feed path of the liner PM extends through a first nip roller 16 and a second nip roller 17.

The container 6 contains a roll of paper R.

The first assisting roller 13 and the second assisting roller 14 are located downstream of the container 6 in the feeding direction. The first assisting roller 13 is located under (LO) the feed path. The second assisting roller 14 is located above (UP) the feed path. That is, when the printer cover 3 is at the closed position, the first assisting roller 13 and the second assisting roller 14 are opposed.

The first assisting roller 13 is connected to a stepping motor. The first assisting roller 13 rotates under the control of the stepping motor.

The second assisting roller 14 rotates following the rotation of the first assisting roller 13.

The first assisting roller 13 and the second assisting roller 14 rotate while keeping the print medium P there between so as to assist the feeding of the print medium P.

The platen roller 10 and the thermal head 12 are located downstream of the first assisting roller 13 and the second assisting roller 14 in the feeding direction. The platen roller 10 is located below (LO) the feed path.

The thermal head 12 is located above (UP) the feed path. That is, when the printer cover 3 is at the closed position, the platen roller 10 and the thermal head 12 are opposed.

The separator 15 is located downstream of the platen roller 10 and the thermal head 12 in the feeding direction.

The upper face and the front face of the separator 15 define a sharp angle.

The first nip roller 16 and the second nip roller 17 are located downstream of the separator 15 in the feeding direction. The first nip roller 16 and the second nip roller 17 are opposed.

The first nip roller 16 rotates following the rotation of the second nip roller 17.

The second nip roller 17 is connected to a stepping motor. The second nip roller 17 rotates under the control of the stepping motor.

The first nip roller 16 and the second nip roller 17 rotate while keeping the liner PM there between so as to feed the liner PM from the separator 15 to the liner ejection port 2*b*.

As the platen roller 10 rotates forward (counterclockwise in FIG. 6), a belt-like print medium P (the combination of labels PL and liners PM) is extracted from the container 6 to the downstream of the container 6 in the feeding direction. The lower face of the extracted print medium P is the non-temporary-adhesive face PMb of the liner PM. The upper face of the extracted print medium P is the print surface PLa.

As the platen roller 10 rotates forward, the first assisting roller 13 rotates counterclockwise in FIG. 6 while having a contact with the non-temporary-adhesive face PMb. At the same time, the second assisting roller 14 rotates clockwise in FIG. 6 while having a contact with the print surface PLa.

The control circuit receives print data corresponding to information to be printed on the print surface PLa (hereinafter called "print information") in response to a user's instruction. The control circuit controls the heater elements to generate heat in accordance with the print data.

When the print medium P passes through between the thermal head 12 and the platen roller 10, the heater elements generating heat are pressed against the print surface PLa. Due to the heat of the heater elements, the thermosensitive layer at the print surface PLa develops a color. As a result, print information (such as a bar code) is printed on the print surface PLa.

The label PL is fed from the front end of the separator 15 to the label ejection port 2*a*.

The liner PM along the front face of the separator 15 is folded back downward (LO) and rearward (RR), and then is fed toward the liner ejection port 2*b*.

In other words, the separator 15 folds back the liner PM at a sharp angle relative to the label PL. As a result, the separator 15 separates the label PL from the liner PM.

The label PL separated from the liner PM is ejected from the label ejection port 2*a*.

The liner PM after the label PL is separated (i.e., the liner PM passing through the front end of the separator 15) passes through between the first nip roller 16 and the second nip roller 17, and then is ejected from the liner ejection port 2*b*.

(4) Connecting and Disconnecting of Thermal Head and Connector Unit

The following describes connecting and disconnecting of the thermal head and the connector unit of the present embodiment.

(4-1) Connecting of Thermal Head to Connector Unit

Figure 7A:
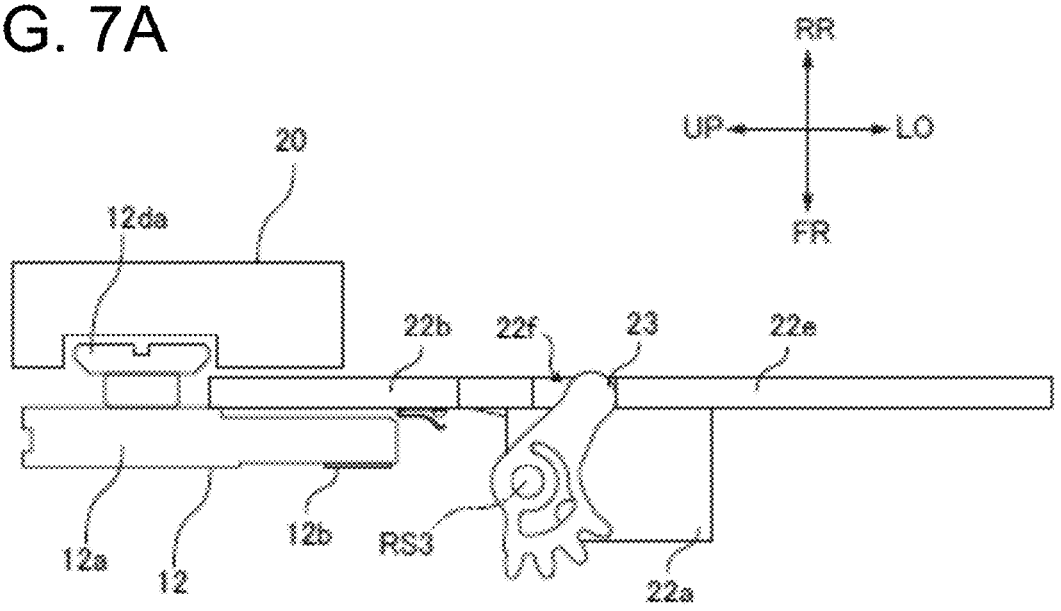
FIGS. 7A and 7B are cross-sectional views showing the thermal head of the present embodiment before connecting to the connector unit.
Figure 7B:
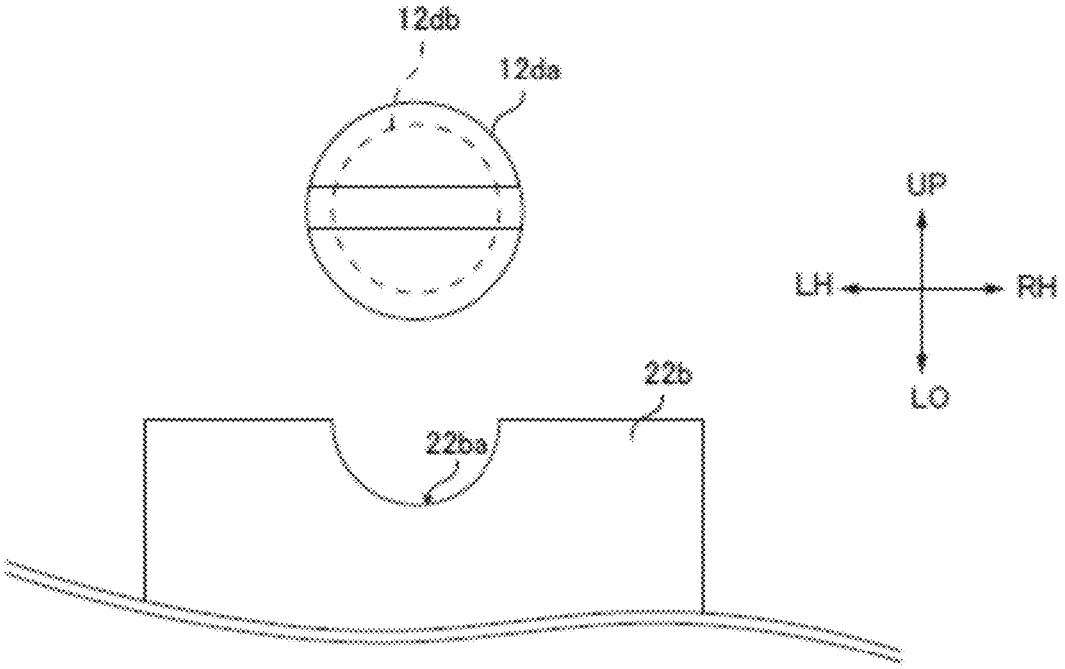
Figure 8:
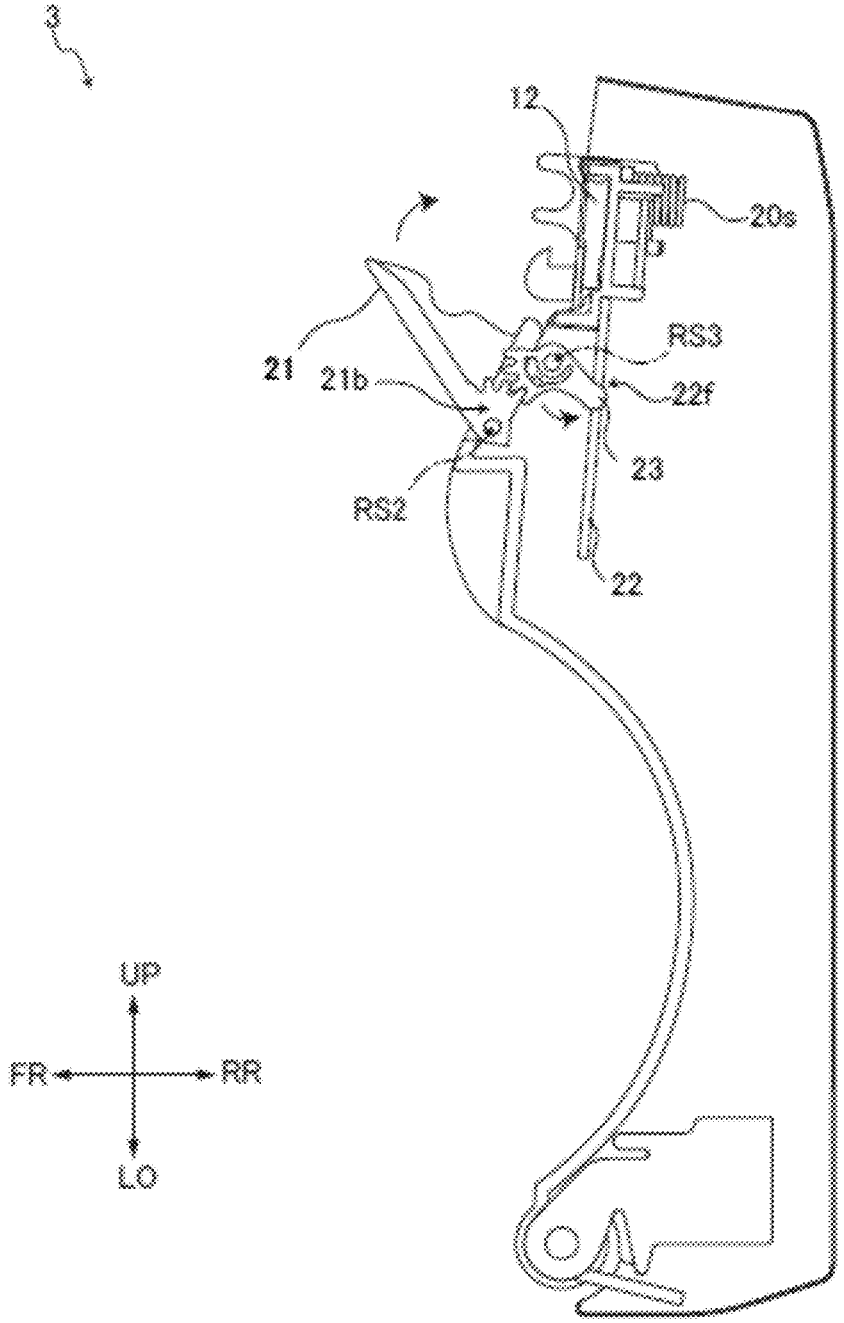
FIG. 8 is a side view of a major part of the opening and closing cover corresponding to FIG. 7.

The following describes connecting of the thermal head to the connector unit of the present embodiment. FIG. 7 is a cross-sectional view showing the thermal head of the present embodiment before connecting to the connector unit. FIG. 8 is a side view of a major part of the opening and closing cover corresponding to FIG. 7. FIG. 9 is a cross-sectional view of the head cover of the present embodiment when the head cover moves from the non-shielding position of FIG. 8 to the shielding position of FIG. 10. FIG. 10 is a side view of a major part of the opening and closing cover when the head cover of the present embodiment is at a shielding position. FIG. 11 is a cross-sectional view showing the thermal head of the present embodiment when connecting to the connector unit.

Before connecting the thermal head 12 to the connector unit 22, a user sets the head cover 21 at the non-shielding position.

Next, as shown in FIG. 2, the user attaches the thermal head 12 to the head bracket 20. Specifically the user fits the pair of concaves 12*e* with the pair of convexes 20*a*. This holds the thermal head 12. That is, the pair of concaves 12*e* and the pair of convexes 20*a* function as a holding part to hold the thermal head 12. The pair of concaves 12*e* (two depressions) are configured to receive convexes 20*a* (two projections) of the head bracket 20 to restrict the thermal head 12 from moving in a feeding direction of print medium P. The printer cover 3 is configured to hold the thermal head 12 via the head bracket 20.

Instead of the concaves 12*e* and the convexes 20*a*, convexes at the thermal head 12 and concaves at the head bracket 20 may hold the thermal head 12.

The abutting part 22*b* extends parallel to the connector 12*b* of the held thermal head 12.

As shown in FIG. 8, when the user rotates the head cover 21 clockwise (i.e., in the opposite direction of the rotating direction of the printer cover 3 when it rotates from the open position to the closed position) around the rotary axis RS2, the gears 23 rotate counterclockwise around the rotary axis RS3 with the rotation of the head cover 21.

Figure 9A:
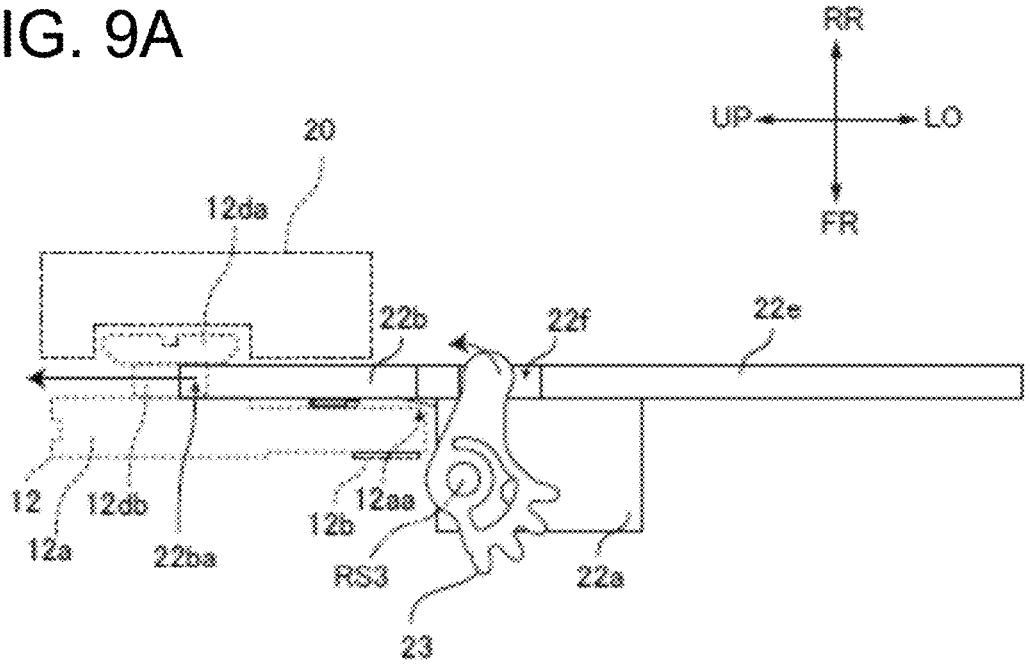
FIGS. 9A and 9B are cross-sectional views of the present embodiment when the head cover moves from the non-shielding position of FIG. 8 to the shielding position of FIG. 10.
Figure 10:
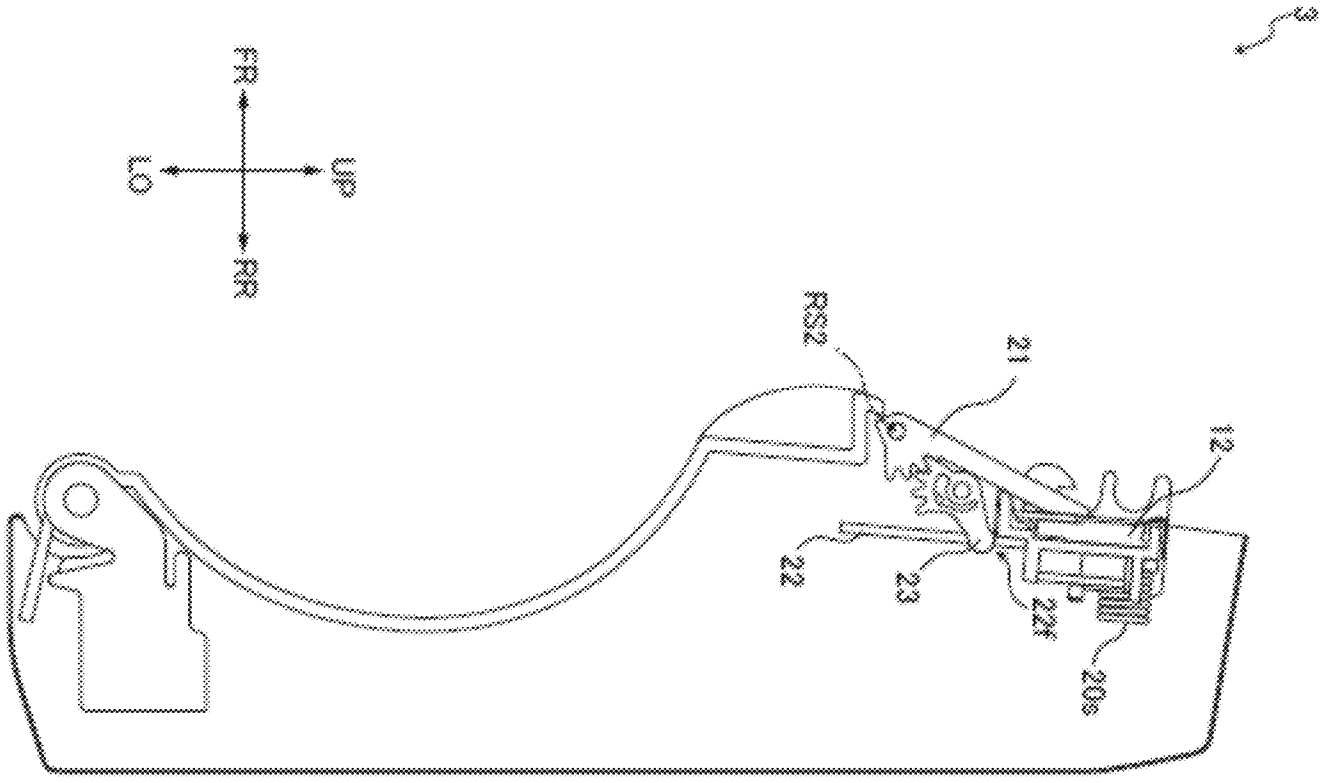
FIG. 10 is a side view of a major part of the opening and closing cover when the head cover of the present embodiment is at a shielding position.

As shown in FIG. 9A, each gear 23 rotates counterclockwise while having a contact with the upper end of the engagement hole 22*f*.

Figure 9B:
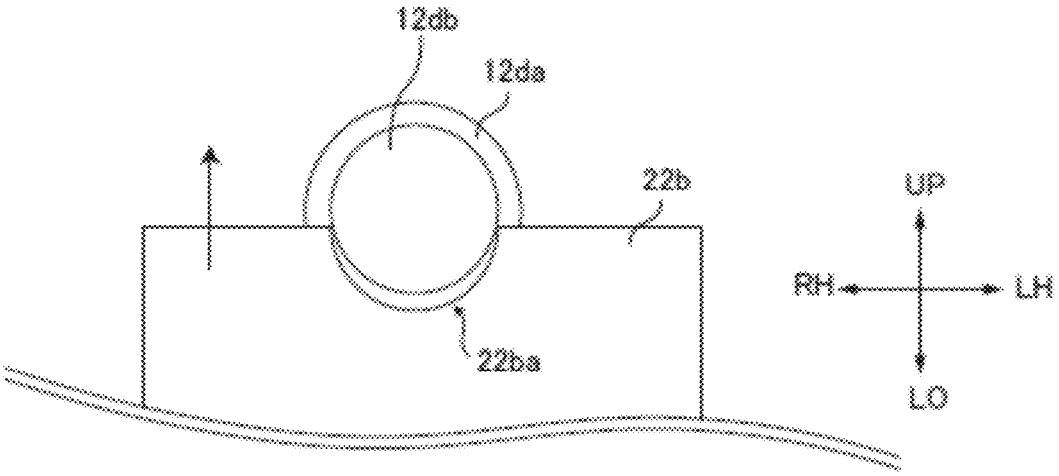

As shown in FIG. 9B, as the gears 23 rotate, the connector unit 22 moves upward (UP) (i.e., in the direction toward the thermal head 12 held by the head bracket 20).

As shown in FIG. 9B, as the gears 23 rotate, the abutting part 22*b* moves upward (UP).

At this time, the abutting part 22*b* comes into contact with the outer periphery of the second limiter 12*db*. Specifically the connector unit 22 moves while having its notch 22*ba* engaging with the connector unit limiter 12*d*. This can limit the position of the connector unit 22 in the up-down direction (UP-LO direction) during connection and disconnection of the connector unit 22 and the thermal head 12.

As shown in FIG. 5, the size d1 of the second limiter 12*db* is substantially the same as the size d2 of the notch 22*ba* in the front-rear direction (FR-RR direction).

When the notch 22*ba* engages with the second limiter 12*db*, the front face of the notch 22*ba* comes into contact with the rear face of the thermal head body 12*a* and the rear face of the notch 22*ba* comes into contact with the front face of the first limiter 12*da*. This enables the positioning of the connector unit 22 in the front-rear direction (FR-RR direction).

That is, the first limiter 12*da* limits the position of the connector unit 22 in the front-rear direction (FR-RR direction). When the thermal head 12 is inserted, the first limiter 12*da* may be adjacent to the head bracket 20 and thus at least partially or momentarily contact the head bracket 20.

The notch 22*ba* engaging with the second limiter 12*db* supports the lower face and the outer periphery of the second limiter 12*db*. This enables the positioning of the connector unit 22 in the up-down direction (UP-LO direction) and in the width direction (LH-RH direction). That is, the second limiter 12*db* limits the position of the connector unit 22 in the moving direction (UP-LO direction) and in the width direction (LH-RH direction).

In this way, the engagement of the notch 22*ba* with the second limiter 12*db* enables the positioning of the connector unit 22. As a result, the connector unit 22 can move in parallel with the thermal head 12.

That is, the second limiter 12*db* and the abutting part 22*b* limit the position of the thermal head 12 in the moving direction (UP-LO direction) of the connector unit 22 and in the directions (FR-RR direction and LH-RH direction) orthogonal to the moving direction (UP-LO direction) of the connector unit 22.

The head bracket 20 has a front face. This front face has a concave to which the first limiter 12*da* retracts.

The second limiter 12*db* and the abutting part 22*b* may limit the position of the thermal head 12 in the moving direction (UP-LO direction) of the connector unit 22 only. In this case, the position of the thermal head 12 is not limited in the directions (FR-RR direction and LH-RH direction) orthogonal to the moving direction (UP-LO direction) of the connector unit 22. That is, the thermal head 12 and the connector unit 22 have a clearance there between in the directions (FR-RR direction and LH-RH direction) orthogonal to the moving direction (UP-LO direction) of the connector unit 22.

Figure 11A:
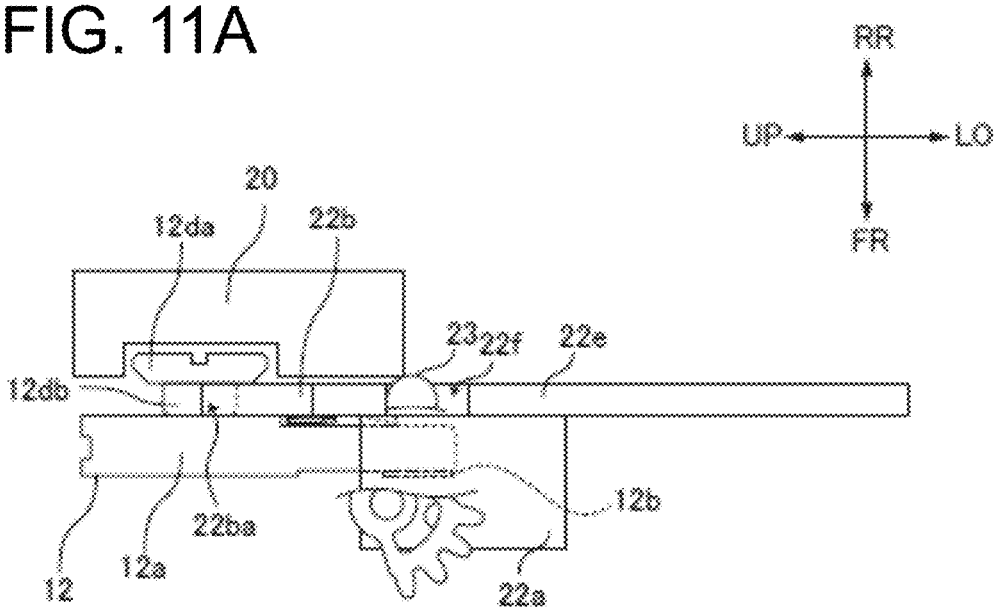
FIGS. 11A and 11B are cross-sectional views showing the thermal head of the present embodiment when connecting to the connector unit.

As shown in FIG. 10, when the head cover 21 reaches the shielding position, the connector 12*b* connects to the connector 22*a* as shown in FIG. 11A.

The pair of engaging parts 21*a* of FIG. 2 engages with the pair of protrusions 20*b*. This engagement functions as a locking part to lock the head cover 21 at the shielding position. This locks the connection of the thermal head 12 to the connector unit 22 as well.

Figure 11B:
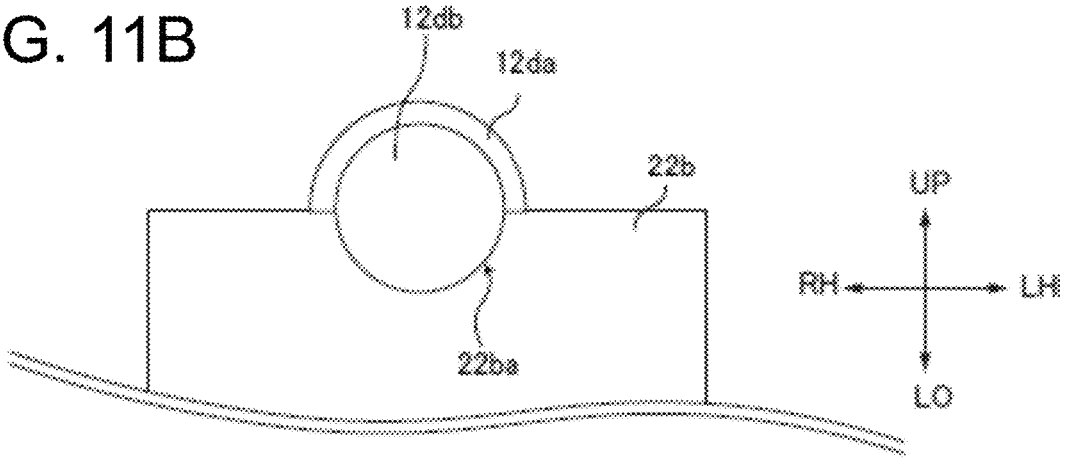

As shown in FIG. 11B, the notch 22*ba* engages with a part of the second limiter 12*db*. This can fix the position of the connector unit 22 connected to the thermal head 12.

(4-2) Disconnecting of Thermal Head from Connector Unit

The following describes disconnecting of the thermal head from the connector unit of the present embodiment. FIG. 12 shows the present embodiment when the head cover moves from the shielding position of FIG. 10 to the non-shielding position of FIG. 8.

In order to disconnect the thermal head 12 from the connector unit 22, the user rotates the head cover 21 counterclockwise in FIG. 10 (i.e., in the opposite direction of the rotating direction of the printer cover 3 when it rotates from the closed position to the open position) around the rotary axis RS2. Then the head cover 21 moves from the shielding position (FIG. 10) to the non-shielding position (FIG. 8) with the rotation.

Figure 12A:
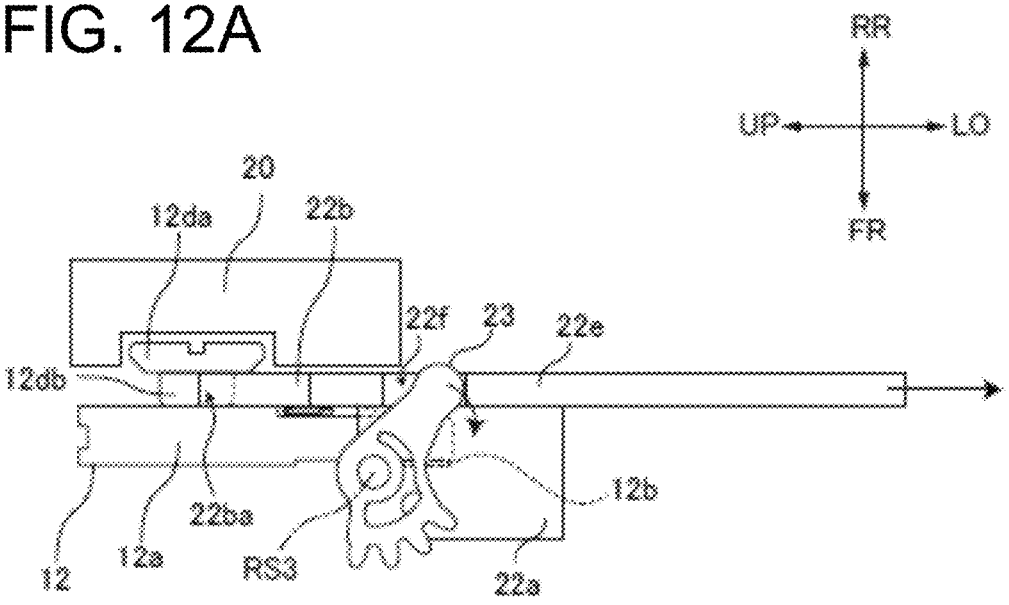
FIGS. 12A and 12B show movement when the head cover moves from the shielding position of FIG. 10 to the non-shielding position of FIG. 8.

As shown in FIG. 12A, each gear 23 rotates clockwise while having a contact with the lower end of the engagement hole 22*f*.

Figure 12B:
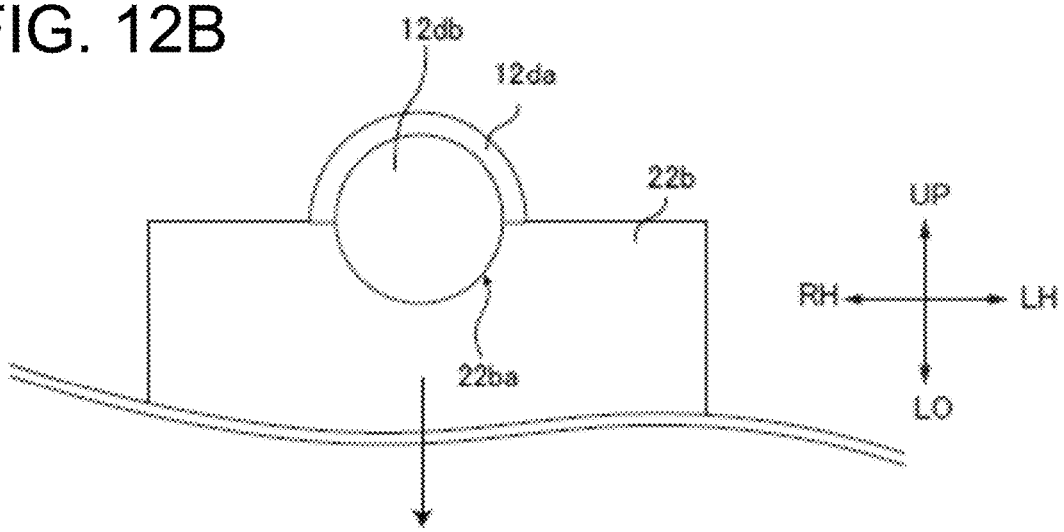

As shown in FIG. 12B, as the gears 23 rotate, the connector unit 22 moves downward (LO) (i.e., in the direction away from the thermal head 12 held by the head bracket 20). This disconnects the thermal head 12 from the connector unit 22.

(5) Summary of Embodiment

The following is a summary of the present embodiment.

As described above, when the user moves the head cover 21 of the present embodiment, connecting or disconnecting of the connector 12*b* as the connecting terminal of the thermal head 12 and the connector 22*a* as the connecting terminal of the printer body occurs. That is, the user can connect or disconnect the thermal head 12 and the connector unit 22 without touching the thermal head 12 and the connector unit 22. This facilitates the connecting and disconnecting of the thermal head 12 and the connector unit 22.

When a user touches the thermal head 12, dirt may adhere to the thermal head 12. Such dirt may cause malfunction of the thermal head 12. According to the present embodiment, after attaching the thermal head 12 to the head bracket 20 for holding, a user need not touch the thermal head 12. This can suppress adherence of dirt to the thermal head 12.

According to the present embodiment, the first limiter 12*da* limits the relative position of the connector unit 22 when the thermal head 12 connects to the connector unit 22. This enables reliable connection of the thermal head 12 to the connector unit 22. The first limiter 12*da* can abut or be adjacent to the head bracket 20 to maintain connectors 12*b* and 22*a* parallel to each other to permit smooth inserting and removing.

In the present embodiment, the pair of concaves 12*e* and the pair of convexes 20*a* hold the thermal head 12 before moving the connector unit 22. This enables reliable connection of the thermal head 12 to the connector unit 22 during connection and disconnection of the thermal head 12 and the connector unit 22.

In the present embodiment, the pair of concaves 12*e* and the pair of convexes 20*a* hold the thermal head 12 when the user attaches the thermal head 12 to the connector unit 22.

This makes the attachment of the thermal head 12 to the connector unit 22 easier.

In the present embodiment, the gear mechanism moves the connector unit 22.

This can minimize the rotary motion of the head cover 21 required for connection or disconnection of the thermal head 12 and the connector unit 22. This can reduce burden on a user's operation required for connection or disconnection of the thermal head 12 and the connector unit 22.

This can minimize a space required to move the head cover 21 as well. This enables easy replacement of the thermal head 12 without increasing the printer 1 in size.

In the present embodiment, engagement of the pair of engaging parts 21*a* with the pair of protrusions 20*b* locks the head cover 21 at the shielding position. This can prevent unexpected cancellation of the connection of the thermal head 12 to the connector unit 22.

In the present embodiment, the head cover 21 at the non-shielding position and the printer cover 3 define a space there between. Since the connector unit 22 is exposed through this space, the user can recognize the connector unit from the outside of the printer 1.

This allows a user to move the head cover 21 to the non-shielding position and then attach the thermal head 12 to the head bracket 20 easily. This facilitates the user attachment or detachment of the thermal head 12 and the connector unit 22.

In the present embodiment, the connector unit 22 moves in parallel with the thermal head 12. This allows the user to connect or disconnect the thermal head 12 and the connector unit 22 easily without breaking the thermal head 12 and the connector unit 22.

As discussed above, print medium P includes a liner PM and labels PL. The height of the liner PM by itself differs from the height of the liner PM and labels PL together. This difference in height can cause movement (rattling) of the thermal head 12 relative to the platen roller 10 as the print medium P moves between the platen roller 10 and the thermal head 12. The head bracket 20 (which holds thermal head 12) is permitted to move relative to the platen roller 10 to accommodate the effect of this height difference. As shown in FIGS. 8 and 10, one or more springs 20*s* are provided on the backside of head bracket 20. The springs 20*s* extend between the head bracket 20 and a fixed support member (not shown) of the printer body and serve to bias (or urge) the head bracket 20 (and thus thermal head 12) towards the platen roller 10 while still permitting movement of the head bracket 20. As mentioned above, the size d1 of the second limiter 12*db* is substantially the same as the size d2 of the notch 22*ba* in the front-rear direction (FR-RR direction) and accordingly, the thermal head 12 and the connector unit 22 move together in response to the bias force from the springs 20*s*. Thus, the design of the thermal head 12 permits the thermal head 12, the head bracket 20, and the connector unit 22 to be fixed to one another and move together with one another. The also improves the integrity and durability of the connection between connector 12*b* and connector 22*a*. Other types of bias members may be used.

(6) Modified Examples

The following describes modified examples of the present embodiment.

Modified Example 1

The following describes Modified Example 1. Modified Example 1 describes a preferable example of a ratio of the number of gear teeth of the pair of gears 21*b* to the pair of gears 23 (hereinafter called a "gear ratio").

A larger gear ratio of the pair of gears 21*b* to the pair of gears 23 is preferred.

Such a larger gear ratio means a smaller amount of rotation of the head cover 21 required for connection or disconnection of the thermal head 12 and the connector unit 22. Such a larger gear ratio means a smaller force required to rotate the head cover 21.

That is, a larger gear ratio can reduce the burden on user's operation to connect or disconnect the thermal head 12 and the connector unit 22.

Modified Example 2

The following describes Modified Example 2. In Modified Example 2, the connector unit 22 moves in response to the operation performed to an operation member different from the head cover 21.

In one example, the printer cover 3 has a lever (one example of the operation member).

The lever has a pair of gears. The pair of gears of the lever engages with the pair of gears 23 (FIG. 2). Such engagement converts the rotary motion of the lever into the motion of the connector unit 22 in the up-down direction (UP-LO direction) via the pair of gears 23.

That is, a gear mechanism is made up of the pair of gears of the lever and the pair of gears 23, and this gear mechanism is a moving mechanism to join with the connector unit 22. This moving mechanism moves the connector unit 22 in response to the rotating operation of the lever.

In Modified Example 2, the head cover 21 can be omitted.

Modified Example 3

The following describes Modified Example 3. In Modified Example 3, the connector unit 22 moves with a motion different from the rotating motion.

In one example, the following describes a head cover 21 in FIG. 2 that is slidable in the up-down direction (UP-LO direction) relative to the printer cover 3.

In FIG. 2, the head bracket 20 has a guide groove at each end in the width direction (LH-RH direction), and the guide grooves extend in the up-down direction (UP-LO direction).

The head cover 21 has a joint part and an engagement part.

The joint part joins the connector unit 22.

The engagement part is located at ends of the head cover 21 in the width (LH-RH direction). The engagement part engages with the guide grooves.

That is, the head cover 21 in Modified Example 3 joins the connector unit 22 and engages with the printer cover 3 slidably.

In order to connect the thermal head 12 to the connector unit 22, a user slides the head cover 21 downward (LO) until the head cover 21 is located at the lower end of the guide grooves (one example of the non-shielding position).

Next, the user slides the head cover 21 upward (UP) until the head cover 21 is located at the upper end of the guide grooves (one example of the shielding position). This moves the connector unit 22 upward (UP) (in the direction toward the thermal head 12).

When the thermal head 12 is to be disconnected from the connector unit 22, the user slides the head cover 21 to the non-shielding position.

As the head cover 21 slides, the connector unit 22 moves downward (LO) (i.e., in the direction away from the thermal head 12).

This disconnects the thermal head 12 from the connector unit 22.

As described above, in Modified Example 3, the sliding operation of the head cover 21 results in connection or disconnection of the thermal head 12 and the connector unit 22.

In Modified Example 3, the pair of gears 21*b* and the pair of gears 23 can be omitted.

Modified Example 4

The following describes Modified Example 4. Modified Example 4 describes an example, in which a connecting board moves with the rotation of the head cover, the connecting board being connectable to the thermal head.

Figure 13:
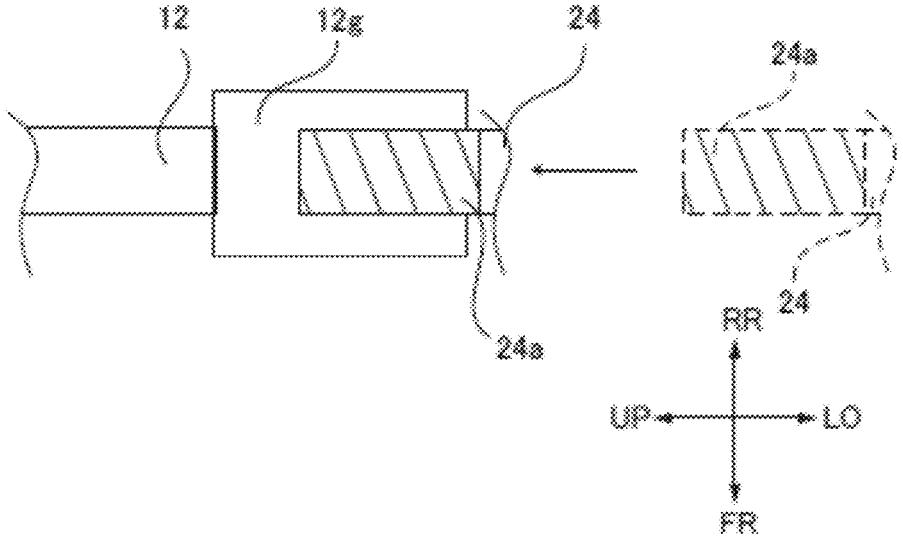
FIG. 13 schematically shows a modified example of the present embodiment.
Figure 14:
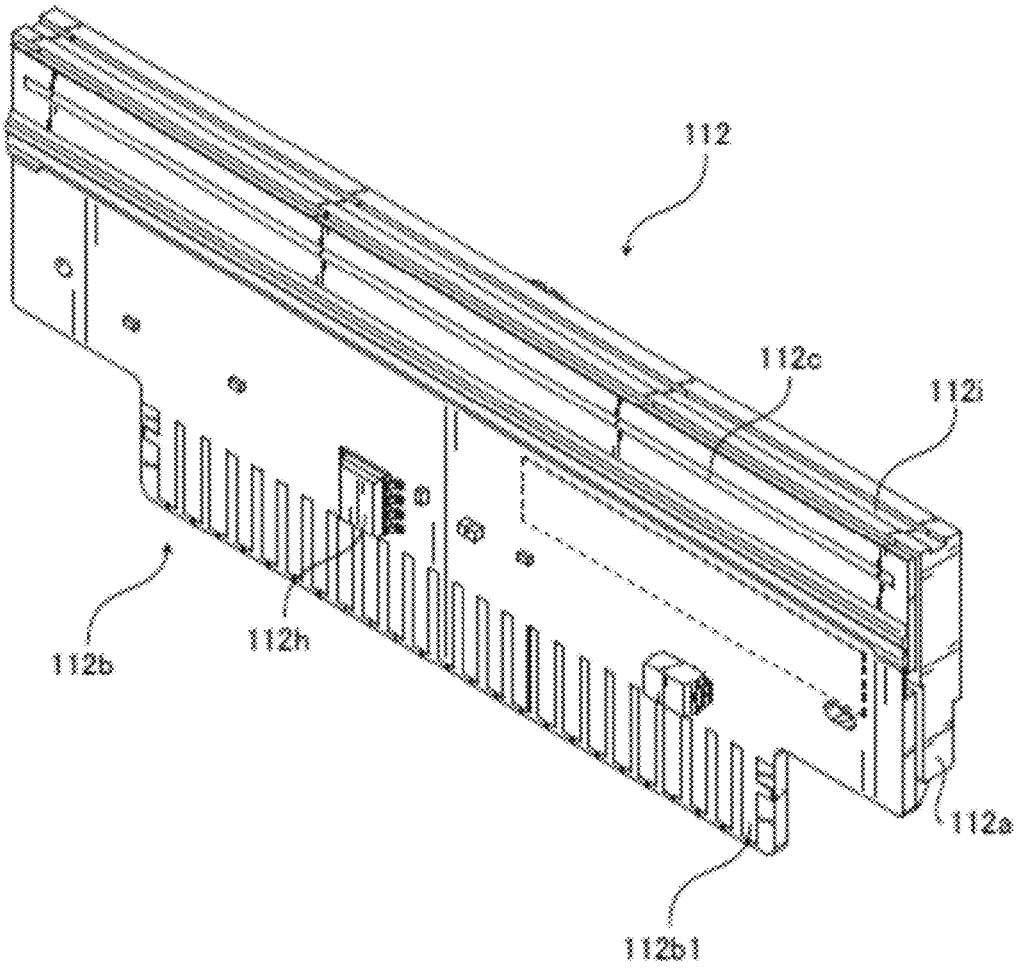
FIG. 14 is a top perspective view of another embodiment.
Figure 15:
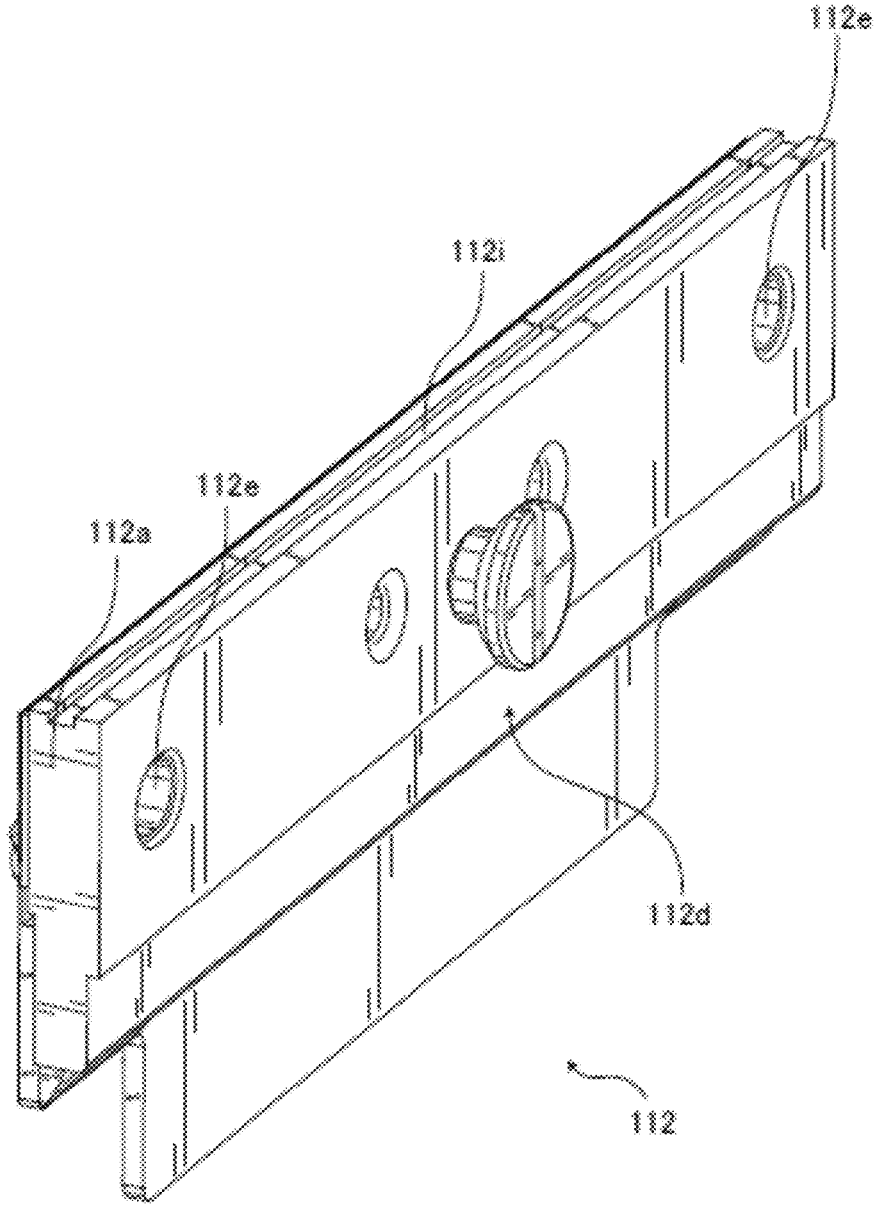
FIG. 15 is a rear perspective view of the design of FIG. 14.
Figure 16:
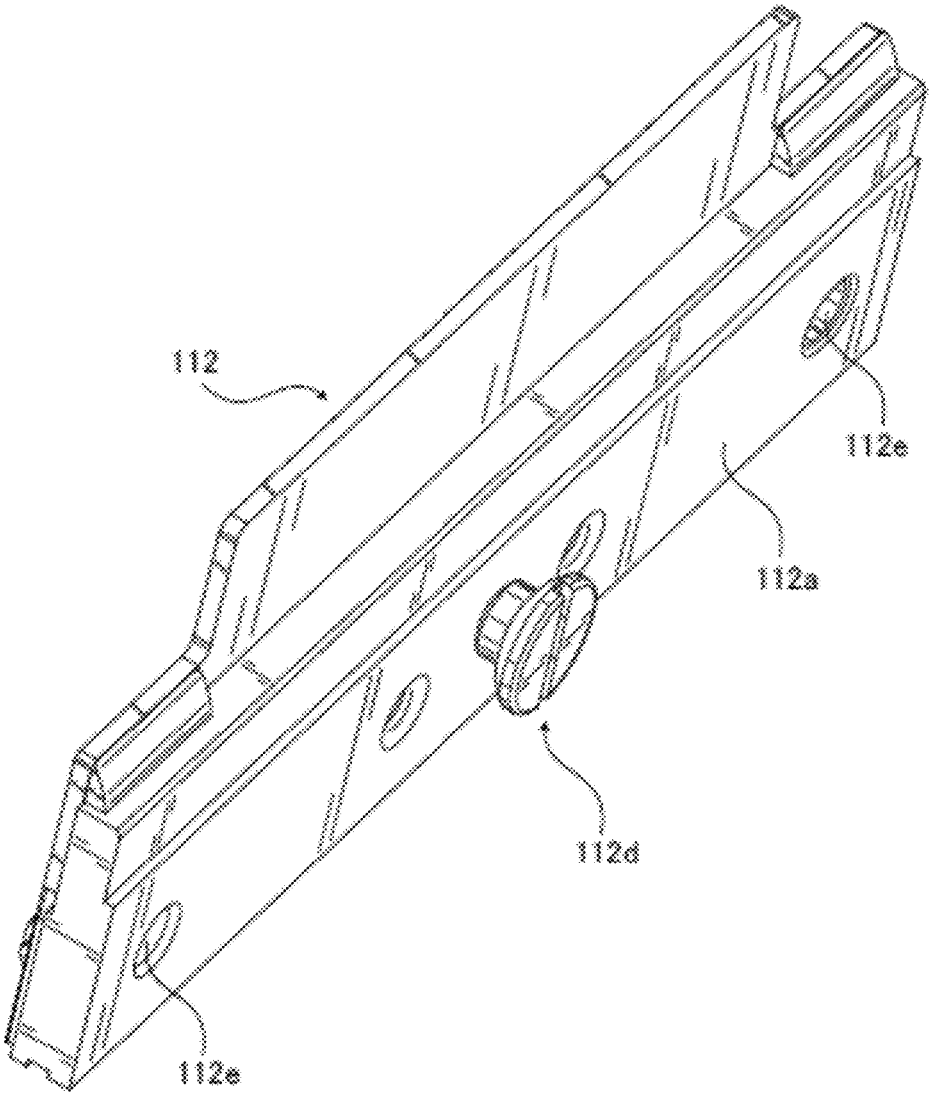
FIG. 16 is a bottom perspective view of the design of FIG. 14.
Figure 17:
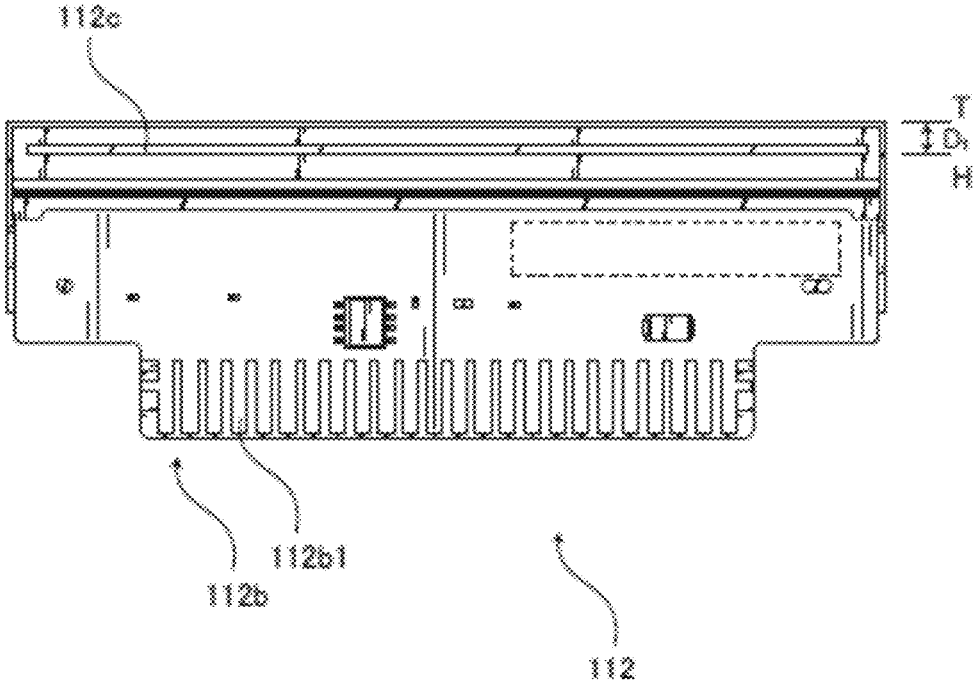
FIG. 17 is a front view of the design of FIG. 14.
Figure 18:
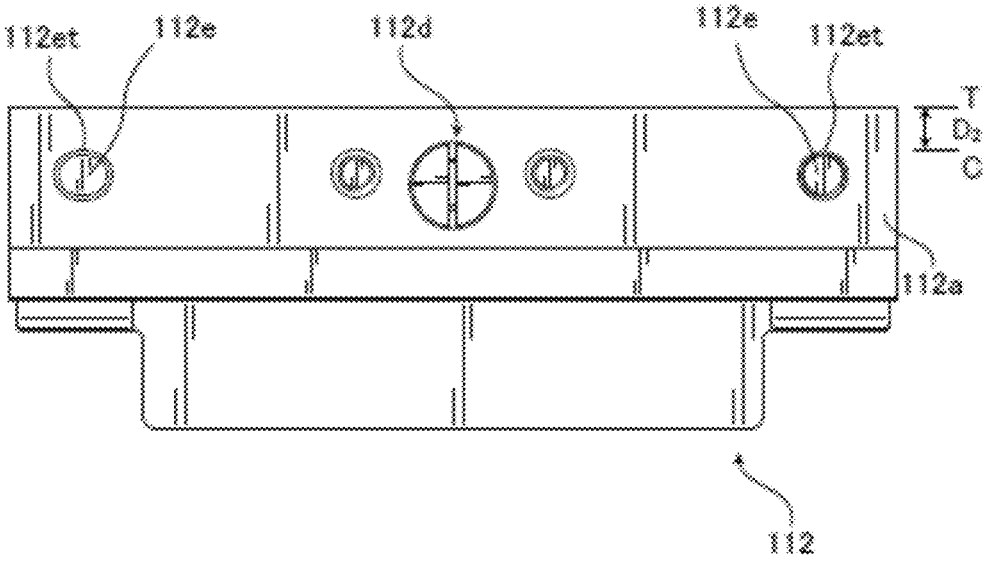
FIG. 18 is a rear view of the design of FIG. 14.
Figure 19:
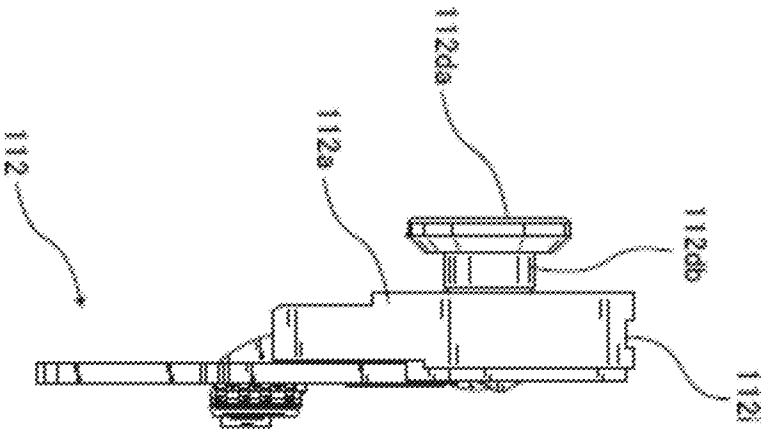
FIG. 19 is a left side view of the design of FIG. 14.
Figure 20:
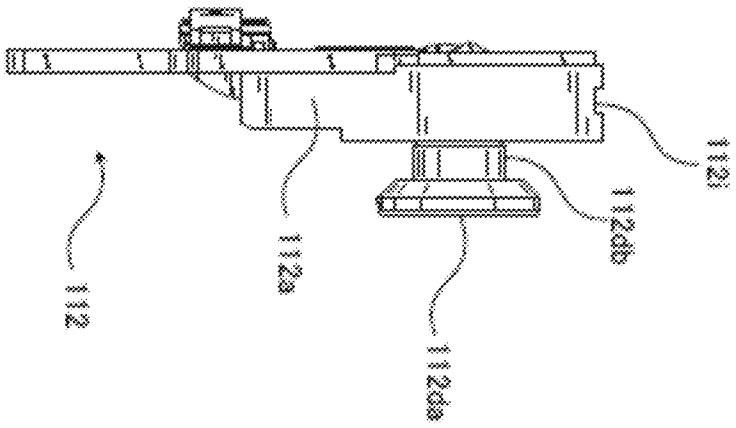
FIG. 20 is a right side view of the design of FIG. 14.
Figure 21:
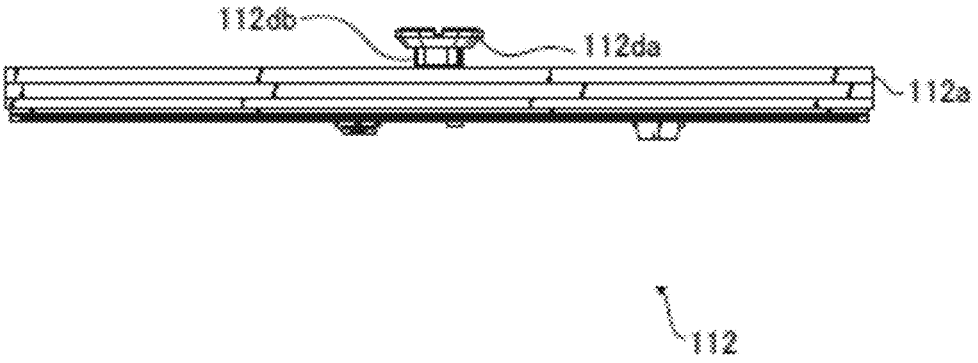
FIG. 21 is a top view of the design of FIG. 14.
Figure 22:
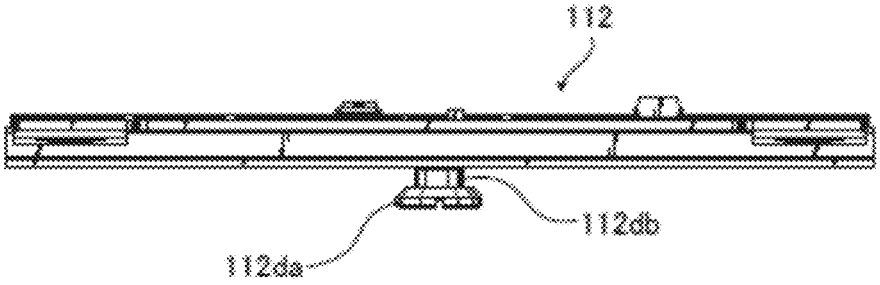
FIG. 22 is a bottom view of the design of FIG. 14.

FIG. 13 schematically shows Modified Example 4 of the present embodiment.

As shown in FIG. 13, a connector 12*g* (one example of the first connector) is attached to the thermal head 12 of Modified Example 4.

The connecting board 24 (one example of the connecting part) can connect to the connector 12*g*. The connecting board 24 includes a connector 24*a* (one example of the second connector). The connector 24*a* protrudes upward (UP) from the connecting board 24.

The connecting board 24 converts the rotary motion of the head cover 21 into the motion of the connecting board 24 in the up-down direction (UP-LO direction) due to a configuration similar to that of FIG. 2, for example.

The rotation of the head cover 21 moves the connecting board 24 in the up-down direction (UP-LO direction). This results in connection or disconnection of the connecting board 24 and the connector 12*g*.

That is, the head cover 21 of Modified Example 4 moves the connecting board 24.

As described above, when the user moves the head cover 21 of Modified Example 4, connection or disconnection of the connector 12*g* as the connecting terminal of the thermal head 12 and the connector 24*a* as the connecting terminal of the printer body occurs. This enables connection or disconnection of the thermal head 12 and the connecting board 24 without touching the thermal head 12 and the connecting board 24. This allows the user to connect or disconnect the thermal head 12 and the connecting board 24.

Modified Example 5

FIGS. 14 to 22 illustrate another embodiment. This example comprises a thermal head 112, and includes a thermal head body 112*a*, a male connector 112*b*, a heater element 112*c*, a connector unit limiter 112*d*, a first limiter 112*da* which forms a head portion, a second limiter 112*db* which forms a narrow portion, concaves 112*e*, and electronic circuits such as integrated circuits 112*h*. This embodiment is similar to the thermal head 12. In this embodiment, the concaves 112*e* and the corresponding protrusion portions (such as portions 20*a*) help tentatively hold the thermal head when the thermal head is first inserted by a user. But the thermal head may still tend to fall forward. The connector unit limiter 112*d* helps prevent the thermal head from falling forward. The second limiter 112*db* forms a narrow portion configured to mate with a portion which extends from the female electrical connector. In this embodiment, the connector 112*b* is made up of twenty four copper electrical contacts 112*b*1 (only a few of which are labeled in the figures).

At least a portion of the thermal head body 112*a*, such as the portion containing concaves 112*e* and the portion behind the heater element 112*c*, is made of a material which readily radiates heat, such as aluminum, aluminum alloy, or other metal that readily radiates heat. The lower edge of heater element 112*c* is aligned along a line H which is spaced from a top (or upper) edge T by a distance $D_1$. The top portion 112*et* of concaves 112*e* are aligned along a line C which is spaced from top edge T by a distance $D_2$. The distance $D_2$ is greater than the distance $D_1$ (by, for example, 1 mm, or 2 mm or more). This ensures that the concaves 112*e* are not directly behind the heater element 112*c*, and thus provides heat-radiating material behind the heater element 112*c*, which helps maintain the temperature of the heater element 112*c* low, which helps maintain print quality.

In this embodiment, one of the concaves 112*e* is cylindrical to match the cylindrical shape of a projection 20*a* and one of the concaves is oval to allow for dimensional variation. However, in other embodiments, the concaves are other shapes, such as rectangular, or simple depressions or lack of material and may not match the shape of the projections.

A groove 112*i* is provided on the top surface of thermal head body 112*a* and is configured to be gripped by a finger or fingernail (or thumb or thumbnail) via notch(es) 20*i* in head bracket 20 to allow a user to easily remove the thermal head 112 from head bracket 20. The notches 20*i* thus permit the groove 112*i* to be at least partially exposed to the user when the thermal head 112 is installed in the head bracket 20. Many other types of indentations or projections may be used instead of groove 112*i*.

Other Modified Examples

The following describes other modified examples.

The above embodiments exemplify the print medium P having the liner PM and the labels PL, however the print medium P is not limited to this. The print medium P may be a label PL without a liner PM, for example.

The above embodiments exemplify printing with the thermal head, however printing is not limited to printing with a thermal head.

The present embodiment is applicable to printing using, for example, an ink ribbon as well.

The scope of the present invention is not limited to the embodiments described above. The above embodiments can be modified or changed without departing from the spirit and scope of the present invention. The above embodiments and modified examples can be combined. For example, a portion of one embodiment or example may be combined with one or more portions of another embodiment or example. Also, the above embodiments (or portion(s) thereof) and/or the above examples (or portion(s) thereof) may be combined with one or more features, components, arrangements, printers, thermal heads, and/or methods described in PCT patent applications PCT/JP2017/030681, PCT/JP2017/030686, PCT/JP2017/030687, and PCT/JP2017/030688, all filed on Aug. 28, 2017, listing Kazuyuki Hoshi as an inventor, designating the United States, and having Sato Holdings Kabushiki Kaisha as an applicant. The entire contents of all four of these PCT applications are incorporated herein by reference for the features, components, arrangements, printers, thermal heads, and methods set forth therein. For example, features, components, arrangements, printers, thermal heads, and methods of PCT patent applications PCT/JP2017/030681 and PCT/JP2017/030686 can be used in combination with features, components, arrangements, printers, thermal heads, and methods described above in connection with FIGS. 2, 8 and 10. As another example, the head cover and printer cover may be arranged as set forth in PCT/JP2017/030687 and/or the head cover or other operation member may be used as a label guide as set forth in PCT/JP2017/030688.

REFERENCE SIGNS LIST

1: printer
2*a*: label ejection port
2*b*: liner ejection port
3: printer cover
6: container
10: platen roller
12: thermal head
12*a*: thermal head body
12*aa*: lower end
12*b*, 12*g*: connector
12*c*: heater element
12*d*: connector unit limiter
12*da*: first limiter
12*db*: second limiter
12*e*: concave
13: first assisting roller
14: second assisting roller
15: separator
16: first nip roller
17: second nip roller
20: head bracket
20*a*: convex
20*b*: protrusion
20*d*: head bracket body
20*i*: notches
21: head cover
21*a*: engaging part
21*b*: gear
22: connector unit
22*a*: connector
22*b*: abutting part
22*ba*: notch
22*e*: connector board
22*f*: engagement hole
23: gear
24: connecting board
24*a*: connector
112: thermal head
112*a*: thermal head body
112*b*: connector
112*b*1: electrical contacts
112*c*: heater element
112*d*: connector unit limiter
112*da*: first limiter
112*db*: second limiter
112*e*: concaves
112*et*: top portion
112*h*: electronic circuits
112*i*: groove

What is claimed is:

1. A thermal head for a printer, the thermal head comprising:
a heater element configured to print information;
a female electrical connector configured to mate with a male electrical connector; and
a connection unit limiter which projects from the thermal head to align the female electrical connector and the male electrical connector with each other.

2. A thermal head as set forth in claim 1, wherein the connection unit limiter comprises:
a first limiter configured to be adjacent to a head bracket; and
a second limiter configured to mate with a portion of the male electrical connector.

3. A thermal head as set forth in claim 1, wherein the connection unit limiter is screw-shaped in cross-section.

4. A thermal head as set forth in claim 1, wherein the connection unit limiter comprises a narrow portion and a larger head portion.

5. A thermal head for a printer, the thermal head comprising:
a heater element configured to print information;
a female electrical connector configured to mate with a male electrical connector; and
two depressions configured to receive projections of a head bracket.

6. A thermal head as set forth in claim 5, wherein the two depressions are configured to receive the projections such that the thermal head is held.

7. A thermal head for a printer, the thermal head comprising:
a heater element configured to print information;
a female electrical connector configured to mate with a male electrical connector; and
at least one depression configured to receive a projection of a head bracket.

8. A thermal head for a printer, the thermal head comprising:
a heater element configured to print information;
a female electrical connector configured to mate with a male electrical connector; and
two depressions configured to receive projections of a head bracket to restrict the thermal head from moving in a feeding direction of a print medium, a top portion of the two depressions being spaced from a top edge of the thermal head farther than the heater element is spaced from the top edge of the thermal head.

9. A thermal head for a printer, the thermal head comprising:
a heater element configured to print information;
a female electrical connector configured to mate with a male electrical connector; and
a groove on a top surface of the thermal head configured to be gripped by at least one of a finger, fingernail, thumb or thumbnail.

10. A thermal head for a printer, the thermal head comprising:
a heater element configured to print information;
a female electrical connector configured to mate with a male electrical connector; and
wherein a top surface of the thermal head is shaped to be gripped by at least one of a finger, fingernail, thumb or thumbnail.

11. A thermal head for a printer, the thermal head comprising:

a heater element spaced from a top edge of the thermal head and configured to print information;

a female electrical connector configured to mate with a male electrical connector;

a connection unit limiter which projects from the thermal head, from a center portion of the thermal head in a width direction, the connection unit limiter comprising a head portion configured to be adjacent to a head bracket and a narrow portion configured to mate with a portion which extends from the male electrical connector; and two depressions configured to receive projections of the head bracket to restrict the thermal head from moving in a feeding direction of a print medium, each of the two depressions being outboard of the connection unit limiter in the width direction, a top portion of the two depressions being spaced from the top edge of the thermal head farther than the heater element is spaced from the top edge of the thermal head.

12. A thermal head as set forth in claim 11, further comprising a groove on a top surface of the thermal head configured to be gripped by at least one of a finger, fingernail, thumb or thumbnail.

13. A thermal head as set forth in claim 11, wherein a top surface of the thermal head is shaped to be gripped by at least one of a finger, fingernail, thumb or thumbnail.

14. A thermal head as set forth in claim 11, further comprising two additional depressions configured to receive projections of the head bracket.

* * * * *